US007385496B2

(12) United States Patent
Ogino et al.

(10) Patent No.: US 7,385,496 B2
(45) Date of Patent: Jun. 10, 2008

(54) MONITORING SYSTEM

(75) Inventors: Hiroyuki Ogino, Nara (JP); Hideki Omori, Akashi (JP); Hidekazu Yamashita, Osaka (JP); Naofumi Nakatani, Osaka (JP); Osamu Eguchi, Kitakatsuragi-gun (JP); Makoto Imai, Yamatokoriyama (JP); Wataru Uchiyama, Toyonaka (JP); Kazuhiko Hashimoto, Moriguchi (JP); Tadashi Miki, Osaka (JP); Haruo Terai, Ikeda (JP); Kenji Kida, Toyonaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 598 days.

(21) Appl. No.: 10/510,986

(22) PCT Filed: Feb. 21, 2003

(86) PCT No.: PCT/JP03/01909

§ 371 (c)(1),
(2), (4) Date: Oct. 13, 2004

(87) PCT Pub. No.: WO03/088174

PCT Pub. Date: Oct. 23, 2003

(65) Prior Publication Data

US 2005/0160325 A1 Jul. 21, 2005

(30) Foreign Application Priority Data

| | | | |
|---|---|---|---|
| Apr. 15, 2002 | (JP) | ..... | 2002-111681 |
| Apr. 15, 2002 | (JP) | ..... | 2002-111682 |
| Jul. 19, 2002 | (JP) | ..... | 2002-211324 |
| Sep. 13, 2002 | (JP) | ..... | 2002-268524 |

(51) Int. Cl.
*G08B 29/00* (2006.01)

(52) U.S. Cl. ..... 340/506; 340/825.36; 340/825.49; 340/524; 340/525; 340/3.1

(58) Field of Classification Search ..... 340/506, 340/825.36, 825.49, 524, 525, 3.1
See application file for complete search history.

(56) References Cited

U.S. PATENT DOCUMENTS 5,400,246 A * 3/1995 Wilson et al. ..... 700/17

FOREIGN PATENT DOCUMENTS

CN 1187659 7/1998

(Continued)

*Primary Examiner*—Daryl C Pope
(74) *Attorney, Agent, or Firm*—Wenderoth, Lind & Ponack, L.L.P.

(57) ABSTRACT

A monitoring system for preventing crime in a home, includes a plurality of terminals for monitoring whether predetermined monitoring points are in a stationary or nonstationary state. Further, the monitoring system includes a central processing device for controlling the setting/canceling of alarm operations of the terminals. The central processing device has a communication unit that receives stationary/nonstationary information from the terminals and transmits predetermined information including commands to the terminals. Each terminal has a communication unit that transmits stationary/nonstationary information to the central processing device and receives the predetermined information from the central processing device. Thus bidirectional communication can be achieved between the central processing device and the terminals. The terminals may include a terminal with an emergency call unit which, in an emergency, calls or notifies another, and a terminal having a notification unit which indicates that a nonstationary state has been accepted by a predetermined point of contact.

37 Claims, 15 Drawing Sheets

FOREIGN PATENT DOCUMENTS

| | | |
|---|---|---|
| CN | 1232237 | 10/1999 |
| EP | 1 239 435 | 9/2002 |
| JP | 58-5898 | 1/1983 |
| JP | 60-175199 | 9/1985 |
| JP | 60-189597 | 9/1985 |
| JP | 11-6393 | 1/1990 |
| JP | 2-116393 | 9/1990 |
| JP | 08-16957 | 1/1996 |
| JP | 08-322810 | 12/1996 |
| JP | 2001-338372 | 12/2001 |
| JP | 2002-8166 | 1/2002 |
| JP | 2002-8167 | 1/2002 |
| JP | 2002-99975 | 4/2002 |
| JP | 2002-109660 | 4/2002 |
| JP | 2002-298255 | 10/2002 |
| TW | 445377 | 7/2001 |
| TW | 466461 | 12/2001 |

* cited by examiner

MONITORING SYSTEM

BACKGROUND OF THE INVENTION

1. Field of the Invention

The present invention relates to a monitoring system which monitors occurrence of a nonstationary state by a central processing device and a terminal, and more particularly, the present invention relates to a monitoring system suitable for preventing crime in a residence.

2. Description of the Related Art

In recent years, in order to cope with an increasing number of property crimes, a demand for systems which monitor residences has increased. A conventional monitoring system for monitoring burglary or the like is constituted by a combination of a plurality of sensor terminals for detecting a burglar and a central processing device for issuing a warning.

For example, a monitoring system disclosed in U.S. Pat. No. 5,920,270 has a plurality of sensor terminals and a residence information board. The monitoring system is designed such that when a sensor terminal detects the burglary, a warning is generated from a loudspeaker arranged on the residence information board.

In another monitoring system disclosed in U.S. Pat. No. 5,461,365, when a terminal held by a user detects an occurrence of an emergency situation, the information of the emergency situation is transmitted to a central processing device by air, and a warning is generated from the central processing device.

In still another monitoring system disclosed in Japanese Patent Laid-Open Publication No. 2002-16715, an information terminal held by a user and a monitoring unit (imaging device) serving as a central processing device can be communicated, and the system has a function of monitoring a state of a place near the monitoring unit and has a function to output the sound which is transmitted from the information terminal and amplified.

In the monitoring system disclosed in U.S. Pat. No. 5,920,270, a place where warning sound is generated corresponds to the position of a central processing device serving as a residence information board, and is not a position where a terminal is installed and where the burglary occurs. Thus, the threatening effect to the burglar is insufficient.

In the monitoring system disclosed in U.S. Pat. No. 5,461,365, when an emergency situation occurs, it can be checked at only a position where the central processing device is installed whether the information of the emergency situation is accurately accepted by a receiver around the central processing device. A user cannot easily recognize that the information is accurately accepted at the position where the user transmits a signal.

According to the monitoring system described in Japanese Patent Laying-Open Publication No. 2002-16715, for example, it is difficult to monitor the sound or voice of burglary or threaten the burglar when the burglary occurs at a place distant from a place where the monitoring unit serving as a central processing device is disposed.

BRIEF DESCRIPTION OF THE INVENTION

The present invention has been made to solve the above problems, and, as its first purpose, provides a monitoring system which can appropriately generate a warning or alarm at a location where a nonstationary state occurs.

It is the second purpose of the present invention to provide a monitoring system which can check that a person to be contacted accepts the information at a location where a nonstationary state occurs.

It is the third purpose of the present invention to provide a monitoring system which can perform voice communication from a central processing device and an external telephone to a location where a nonstationary state occurs.

A monitoring system according to the present invention includes a plurality of terminals for monitoring whether predetermined monitoring points are in a stationary state or a nonstationary state, and one central processing device for controlling a setting/canceling operation of alarm operations of the terminals. The central processing device has a communication unit that receives information related to the stationary/nonstationary states from the terminals and transmits predetermined information including commands to the terminals. Each terminal has a communication unit that transmits information related to stationary/nonstationary states to the central processing device and receives the predetermined information from the central processing device. According to this configuration, the monitoring system can be achieved that can provide bidirectional communication between the central processing device and the terminals.

In the monitoring system, at least one of the plurality of terminals may further have a controller that receives a command from the central processing device to autonomously start an alarm operation, and a alarm unit that generates a warning on occurrence of a nonstationary state.

In the monitoring system, at least one of the plurality of terminals may further have an emergency call unit that transmits information indicating a nonstationary state by an operation of a user and a notification unit that performs notification by at least one of a visual method and an auditory method. In this case, when receiving the information indicating the nonstationary state from the emergency call unit of at least one terminal, the central processing device may transmit a confirmation signal to the terminal. When receiving the confirmation signal from the central processing device, the terminal may notify, through the notification unit, that the transmission of the information can be accepted.

DETAILED DESCRIPTION OF THE INVENTION

Preferred embodiments of a monitoring system according to the present invention will be described below with reference to the accompanying drawings.

First Embodiment

Figure 1:
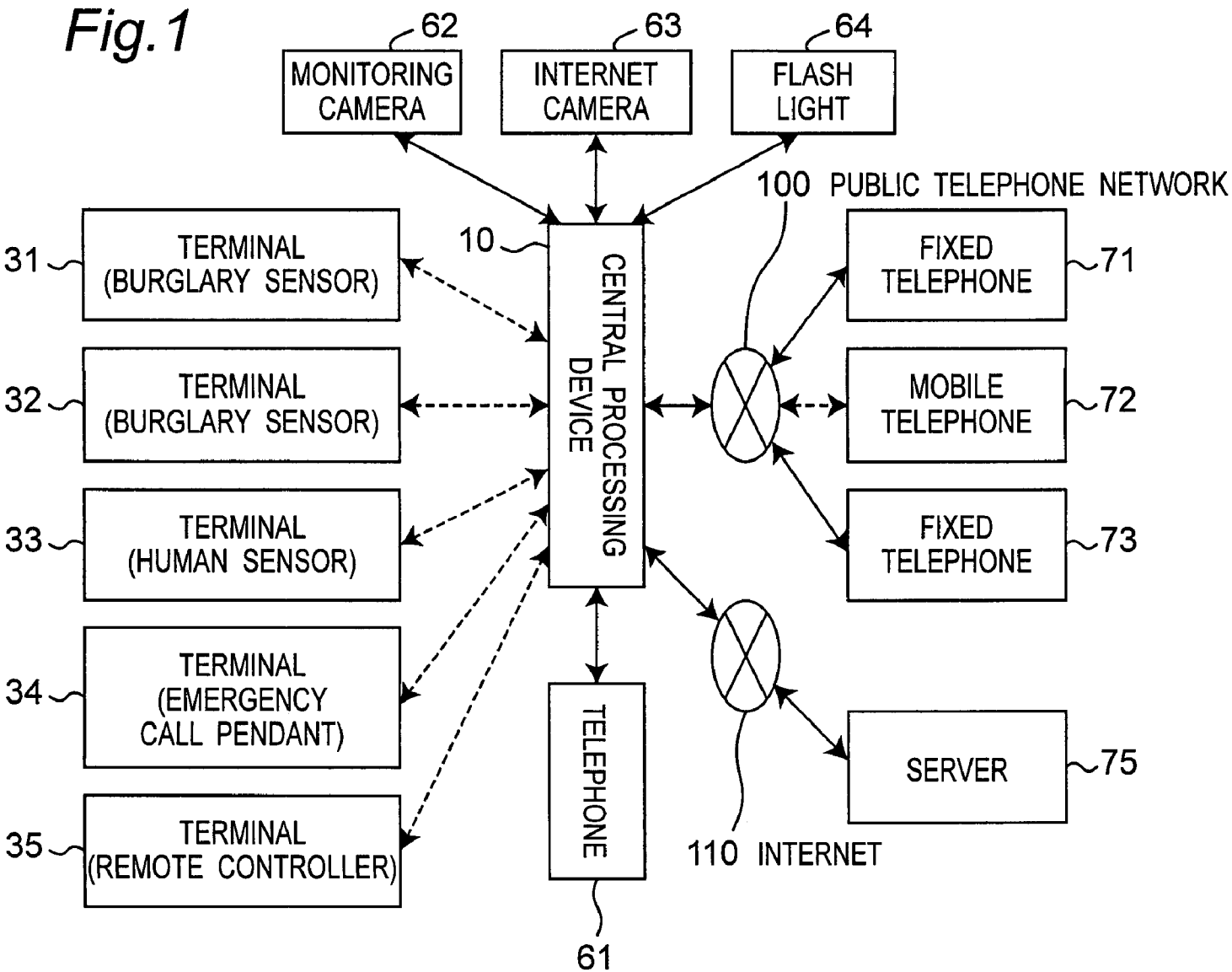
FIG. 1 is a diagram showing the configuration of a monitoring system according to the present invention.

FIG. 1 is a diagram showing a configuration of a monitoring system according to the present invention. The monitoring system according to the present invention is a security system for preventing crime in a residence having a function of intimidating and notifying when a burglary on the residence is detected, a function of notifying a predetermined destination when an emergency situation occurs in a residence, and the like.

As shown in FIG. 1, the monitoring system includes a central processing device 10 and a plurality of terminals 31 to 35. The central processing device 10 and the terminals 31 to 35 are connected to each other by a wireless communication means. As the communication means, a specific low-power wireless network (ECHONET) may be used.

The central processing device 10 is connected to a public telephone network 100 to which communication devices such as fixed telephones 71 and 73 and a mobile telephone 72 and the internet 110 to which a data server 75 is connected. The central processing device 10 is connected to the telephone 61 in a residence.

In the terminals 31 to 35, control for starting/stopping an alarm operation or setting of parameters are performed in response to a command transmitted from the central processing device 10. In this case, the terminals 31 and 32 include burglary sensors and can detect occurrence of burglary. The terminal 33 includes a human sensor and can sense approach of a human being. The terminal 34 includes an emergency call means and can notify that an emergency situation occurs to a holder of the terminal 34. The terminal 35 includes an operation means for remotely controlling the central processing device 1. Other terminals for detecting states of different types from the above described types may be connected to the central processing device 10. In the following description, the reference numeral "30" is used for generically to the terminals 31 to 35.

Figure 2:
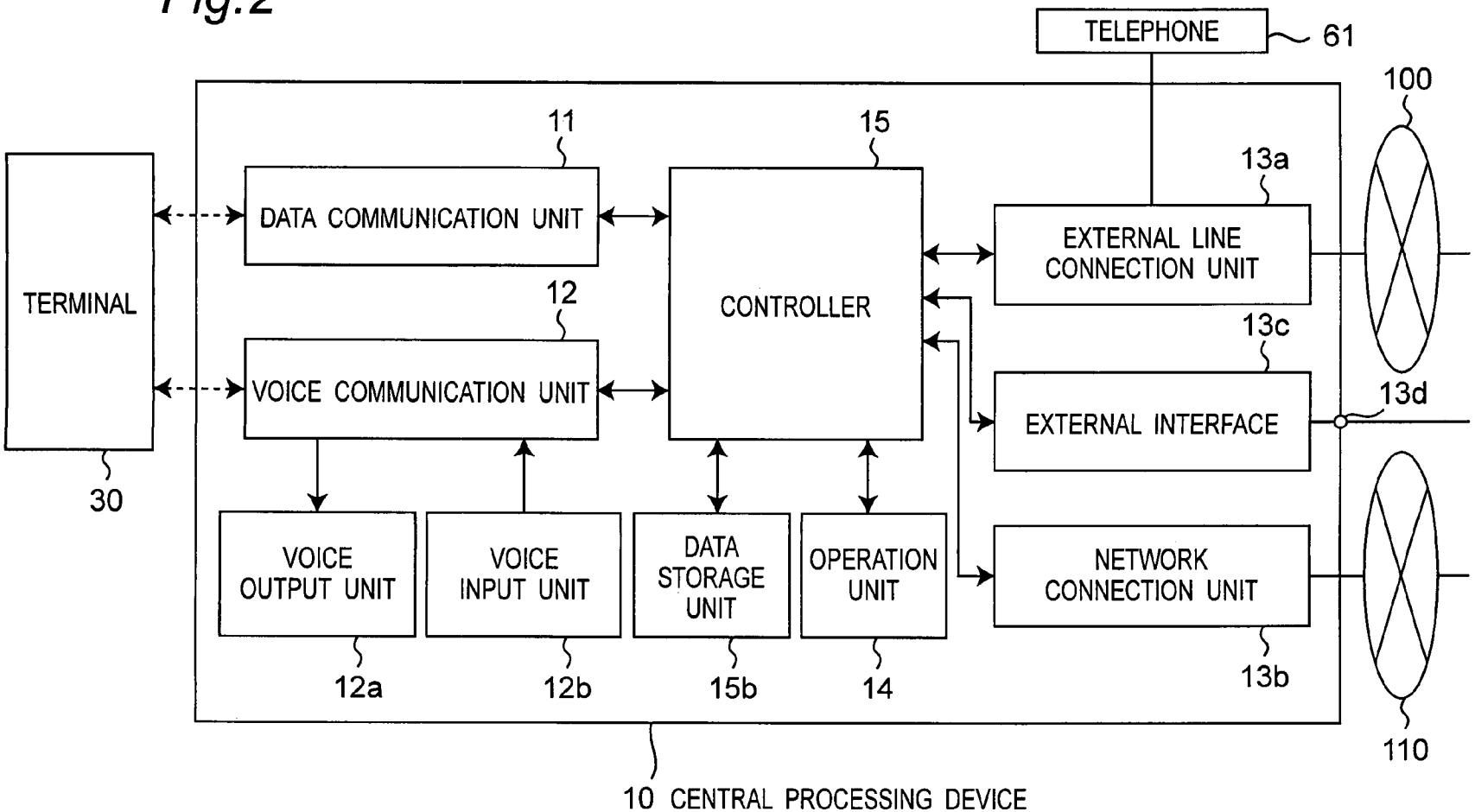
FIG. 2 is a diagram showing an exemplary configuration of a central processing device.

FIG. 2 is a block diagram showing an example of the configuration of the central processing device 10. The central processing device 10 includes a data communication unit 11 for controlling data communication with the terminal 30, a voice communication unit 12 for modulating/demodulating voice and communicating with the terminal 30, an external line connection unit 13*a* to be connected to a public telephone line, a network connection unit 13*b* to be connected to the internet, an external interface 13*c* to be connected to an external device, an operation unit 14 by which a user performs various settings to the central processing device 1, and a controller 15 for controlling an overall operation of the central processing device 1. A telephone line from the public telephone network 100 is branched to the telephone 61 and the inside of the central processing device 10 by the external line connection unit 13*a*. Therefore, a normal call can be achieved by the telephone 61.

The voice communication unit 12 is connected with a voice output unit 12*a* for amplifying the voice output from the voice communication unit 12, and a voice input unit 12*b* for transmitting the voice from the central processing device 10 to the terminal 30.

The operation unit 14 includes a plurality of buttons (keys) for inputting predetermined settings and a display panel for displaying various pieces of information. On the display panel of the operation unit 14, for example, the states (stationary/nonstationary) of the respective terminals, setting information, and the like are displayed.

The external interface 13*c* is connected, through the external terminal 13*d*, with external devices such as a monitoring camera 62 operable to store images, an internet camera 63 capable of being connected to the internet, and a flash light 64 for notifying neighbors of occurrence of abnormality (see FIG. 1). These external devices are provided with no-voltage contact input terminals to which an external terminal 13*d* is connected.

The central processing device 10 has a data storage unit 15*b* for storing information required for the operation of the central processing device 10. The data storage unit 15*b* stores contact points (telephone numbers) in an occurrence of a nonstationary state, stores information related to a message depending on the type of a nonstationary state, stores information for a location of a terminal, stores a threatening message, and the like. The contact point (telephone numbers) on the occurrence of the nonstationary state is prioritized and stored. The data storage unit 15*b* stores operation history information generated in an alarm operation or information related to a stationary/nonstationary state of a terminal.

Figure 3:
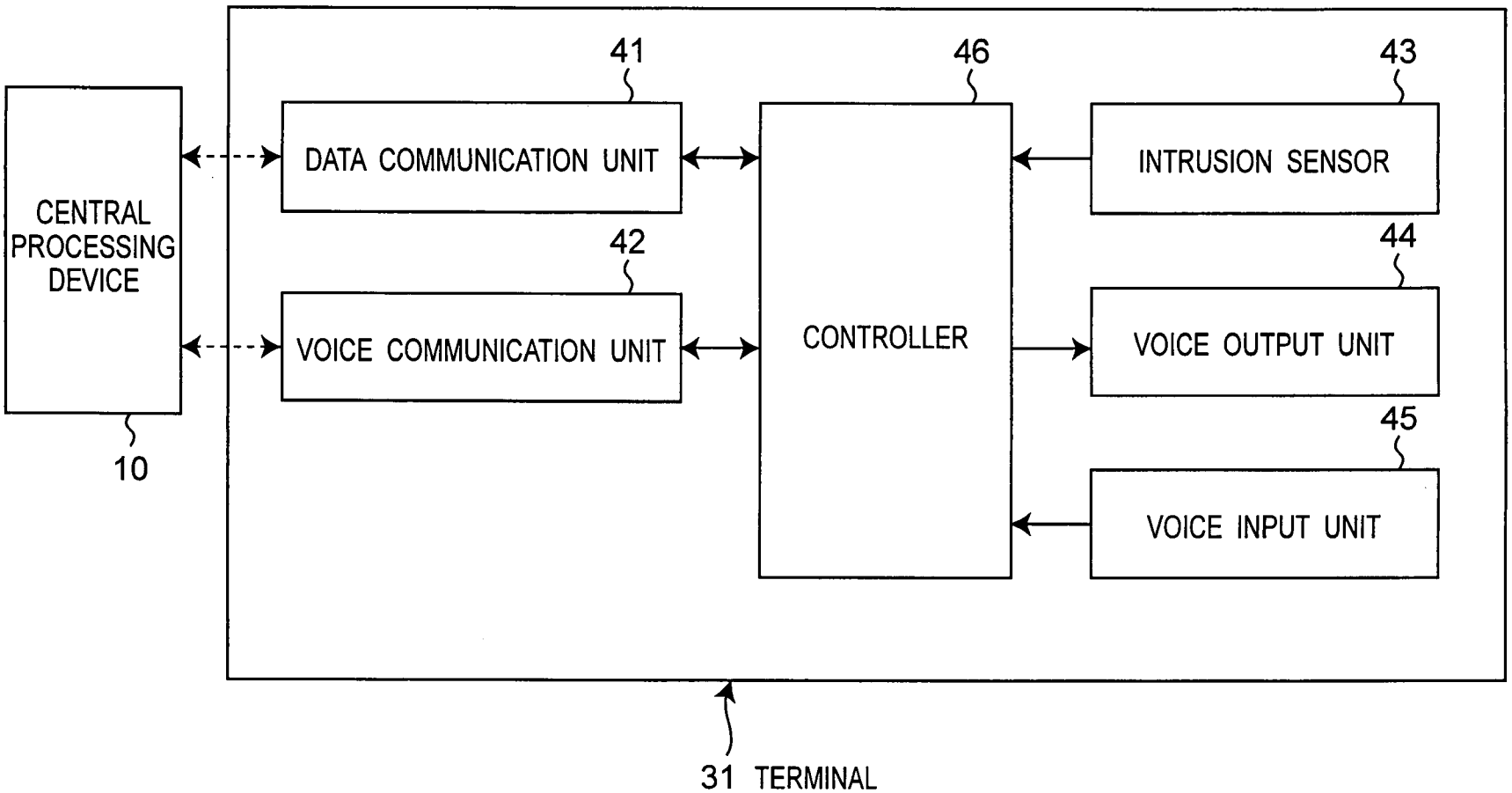
FIG. 3 is a diagram showing an exemplary configuration of a terminal having a burglary sensor.

FIG. 3 is a block diagram showing an example of the configuration of the terminal 31 (or the terminal 32) having a burglary detection function. The terminal 31 has a lead switch to detect an occurrence of a burglary. The terminal 31 is fixed to a frame of a window or a door, and a magnet corresponding to the lead switch is fixed to a movable window glass or a movable section of the door, so that the opening/closing state of the window or the door can be detected. More specifically, when the opening/closing state of the window or the door is detected, the occurrence of the burglary can be detected.

The terminal 31 has a data communication unit 41 for performing data communication with the central processing device 10, a voice communication unit 42 for conducting voice communication with the central processing device 10, and a controller 46 for controlling the operation of the terminal 31. The terminal 31 further has a burglary (intrusion) sensor 43 for detecting occurrence of burglary and a voice output unit (loudspeaker or the like) 44 for amplifying an audio signal received and demodulated by the voice communication unit 42. Also, the terminal 31 has a voice input unit (microphone or the like) 45 which inputs the received external sound or voice. Sound around the terminal 31 collected by the voice input unit 45 is modulated by the voice communication unit 42 and transmitted to the central processing device 10.

When the burglary sensor 43 detects an occurrence of a burglary, the burglary sensor 43 outputs a nonstationary signal (i.e., a signal representing that a burglary has occurred) to the controller 46. When the controller 46 receives the signal, the controller 46 transmits a code representing occurrence of the nonstationary state (occurrence of the burglary) and the terminal code (address code) of the controller 46 as nonstationary state information to the central processing device 10 through the data communication unit 41 by air.

Figure 4:
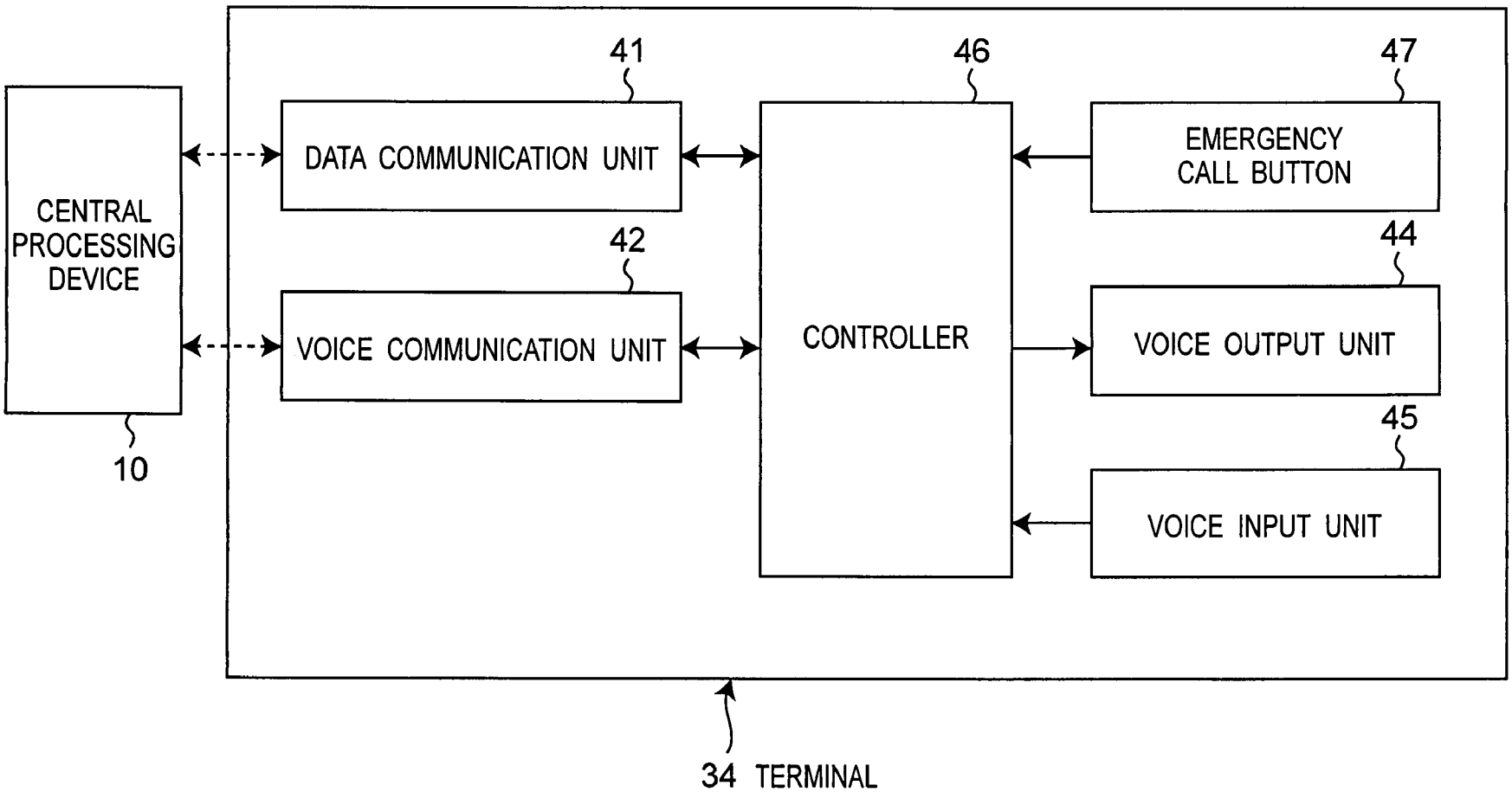
FIG. 4 is a diagram showing an exemplary configuration of a terminal having an emergency call button.

FIG. 4 is a block diagram showing an example of the configuration of the terminal 34 having a notifying function of occurrence of an emergency situation. The terminal 34 includes an emergency call button 47 in place of the burglary sensor 43 of the configuration shown in FIG. 3. The emergency call button 47 is a push button switch. A user depresses this switch to make it possible to notify of an occurrence of an emergency situation. More specifically, when the switch is depressed, the emergency call button 47 outputs a nonstationary state signal (i.e., a signal representing that a user is in an emergency situation) to the controller 46. When the controller 46 receives the nonstationary state signal from the emergency call button 47, the controller 46 transmits a code representing the occurrence of the nonstationary state (occurrence of an emergency situation) and a terminal code of the controller to the central processing device 10 through the data communication unit 41 by air.

An overall operation of a monitoring system having the above configuration will be described below.

An alarm operation of the monitoring system is started by setting an alarm mode by a user. The alarm mode is set by a user on the operation unit 14 of the central processing device 10. The alarm mode includes two types of alarm modes. One is an alarm mode (going-out alarm mode) set when a user is away from home, and the other is an alarm mode (at home alarm mode) set when the user is at home, e.g., when the user is asleep.

First, an operation in the going-out alarm mode which is the alarm mode set when the user goes out will be described below.

When a user sets the going-out alarm mode on the operation unit 14 of the central processing device 10 to go out, the central processing device 10 transmits a start request signal of an alarm operation to the terminals 30. When the terminals 30 receive the start request signal, the terminals 30 ring buzzers for a predetermined period (e.g., 1 second) to call the user's attention. Thereafter, the alarm mode is set, and the alarm operation is started. The sound of the buzzer at this time is different from a warning sound generated when a burglary is detected.

During the alarm operation, for example, when the window or the door on which the terminal 31 having the burglary function is fixed is opened (i.e., a nonstationary state occurs), the burglary sensor 43 operates to output a nonstationary state signal to the controller 46. The controller 46 transmits a code representing the occurrence of the nonstationary state and an address code of the own terminal code to the data communication unit 41. The data communication unit 41 sequentially transmits the address code of the own terminal code and a state code representing the occurrence of burglary, as nonstationary state information, to the central processing device 10. After the terminal 31 transmits the nonstationary state information, the voice communication unit 42 is set in a standby state by the controller 46.

The central processing device 10 receives a signal from the terminal 31 via the data communication unit 11, analyzes the signal using the controller 15, decides a specific terminal from which the signal is transmitted, and recognizes that a burglary has occurred. The controller 15 operates the external line connection unit 13*a* to connect, through the public telephone network 100, the external line connection unit 13*a* to telephone 71 or 73 or a mobile telephone 72 which are registered for notification and correspond to a telephone number registered in the data storage unit 15*b* in advance. Then the controller 15 transmits a voice message for notifying a location where the burglary occurs and the occurrence of the burglary. In this case, when the contact point (telephone number) dialed by the external line connection unit 13*a* is not connected to the line, the other contact points registered in the data storage unit 15*b* are sequentially dialed until the contact point is connected to the line. When the contact points are not connected to the line even though all the registered contact points are dialed, the connections are tried a predetermined number of times (e.g., five times). When the contact points are not connected to the line after the predetermined number of trials, it is recorded in a predetermined recording region of the central processing device 10 as history information that the telephone communication cannot be established.

A user notified by the telephone 71, 72 or 73 transmits a predetermined tone signal from the telephone 71, 72 or 73. When the central processing device 10 receives the predetermined tone signal from the user away from home through the external line connection unit 13*a*, the controller 15 operates the voice communication unit 12. The central processing device 1 transmits common call signals to the plurality of terminals 30 through the voice communication unit 12. At this time, in the terminal 31 which transmits a nonstationary state information, the voice communication unit 42 is set in a standby state in advance, when the common call signal is received from the voice communication unit 12 of the central processing device 10. The voice communication unit 42 of the terminal 31 operates to establish a telephone communication link between the terminal 31 and the telephone 71 through the central processing device 10.

With the above operation, sound or voice generated around the terminal 31 which detects occurrence of burglary can be monitored through the voice input unit 45 by the telephone 71, 72 or 73, so that a situation around the location where the burglary occurs can be monitored. Additionally, the user can threaten the burglar with user's voice from the voice output unit 44 of the terminal 31. In addition, when a receiver transmits a predetermined tone signal through the telephone 71, 72 or 73, a predetermined operation (e.g., stop of alarm in a terminal (to be described later)) can be performed to the central processing device 10.

In this embodiment, the terminal 31 includes both the voice output unit 44 and the voice input unit 45. However, the terminal 31 may have any one of the voice output unit 44 and the voice input unit 45.

An operation in the at home alarm mode which is an alarm mode set when the user is at home will be described below.

The at home alarm mode is set, for example, when the user is in the home and is asleep at night. A terminal operated in the at home mode can be arbitrary selected and set by the user. In this manner, for example, when the user is asleep on the second floor, only the terminals on the first floor may be operated to receive a nonstationary state information, i.e., only some terminals may receive the nonstationary state information. In the alarm operation during the at home alarm mode, when the terminal 31 detects an occurrence of burglary, as in the going-out alarm mode, the nonstationary state information is output from the terminal 31 to the central processing device 10. However, during the at home alarm mode, when the central processing device 10 receives the nonstationary state information from the terminal 31, the voice communication unit 12 is operated without accessing the public telephone network 100. More specifically, a sound signal from the terminal 31 is not transmitted to the telephone 71, 72 or 73, and amplified sound is output from the voice output unit 12*a* of the central processing device 10.

With the above operation, in the central processing device 10, the situation can be monitored by sound or voice generated around the site where the burglary occurs. In addition, in this case, an audio signal can be output from the voice input unit 12*b* of the central processing device 10 to the terminal 31. Hence, the burglar can be threatened by the sound or voice generated by the central processing device 10 through the terminal 31.

In this embodiment, both the voice output unit 12*a* and the voice input unit 12*b* are included in the central processing device 10. However, only one of the voice output unit 12*a* and the voice input unit 12*b* may be included in the central processing device 10. Furthermore, even in the at home alarm mode, for a predetermined period, when the at home alarm mode is set, buzzer sound for calling user's attention is generated from the terminals 30.

With respect to a setting operation and a cancel operation for the alarm operation, a personal identification number or a password for setting/canceling the alarm operation may be stored in the data storage unit 15*b* of the central processing device 10. In this case, when a user sets/cancels the alarm operation, the user is requested to input a personal identification number or a password. Only when the input personal identification number of the input password coincides with an input personal identification number stored in the data storage unit 15*b*, the alarm operation may be set/canceled.

When the terminals 30 are driven by a battery, the controller of the terminal may monitor the voltage of the battery, and when the voltage of the battery is equal to or lower than a predetermined voltage the controller may transmit a signal representing voltage drop to the central processing device. At this time, when receiving the signal, the central processing device 10 may display, on the display of the operation unit 14, an abnormal state indicating that the terminal is running out of battery power.

The central processing device 10 stores information representing an open/close state transmitted from the terminal 31 or 32 having a burglary sensor for detecting the opening/closing of a window or a door, in the data storage unit 15*b*. When an alarm operation is set and input by the operation unit 14 and the state of the terminal 31 or 32 is "open", it may be displayed on the display of the operation unit 14 that a door-lock check is abnormal.

An operation related to an emergency call will be described below.

Even though a user is at home, if the burglary occurs to require an urgent action, or if the physical condition of the user suddenly changes to require outside contacts, while in the alarm mode, it is possible to transmit the address code of the terminal 34 and a state code representing the occurrence of the emergency situation to the central processing device 10 when the user carrying the terminal 34 having the emergency call function depresses the emergency call button 47.

The central processing device 10 receives the signal from the terminal 34 through the data communication unit 11, and analyzes, using the controller 15, the received signal to recognize that the emergency situation occurs. The controller 15 operates the external line connection unit 13*a* to connect the external line connection unit 13*a* to the telephone 71 or 73 or the mobile telephone 72 corresponding to telephone numbers registered for notification in the data storage unit 15*b* in advance through the public telephone network 100, and transmits a voice message for notifying that the emergency situation occurs.

A contact person who receives the message at the telephone 71, 72 or 73 transmits a predetermined tone signal from the telephone 71, 72 or 73. When receiving the predetermined tone signal, the central processing device 10 operates the voice communication unit 12 through the controller 15. In the terminal 34 which transmits the nonstationary state information, the voice communication unit 42 is set in a standby state. When the terminal 34 receives a call signal from the voice communication unit 12 of the central processing device 10, the voice communication unit 21 starts to operate.

With the above operation, the voice of the user carrying the terminal 34 can be monitored by the telephone 71, 72 or 73 through the voice input unit 45, and thus user's situation can be checked. If necessary, the user can be called on by the voice of the contact person from the voice output unit 44 through the telephone 71, 72 or 73.

In this embodiment, both the voice output unit 44 and the voice input unit 45 are included in the terminal 34. However, any one of the voice output unit 44 and the voice input unit 45 may be included in the terminal 34 as needed.

The telephone numbers stored in the data storage unit 15*b* may be independently set such that the priority order of notification destinations used when detecting the burglary by a terminal with a burglary detection function is different from the priority order of those used when pressing an emergency call button of a terminal having an emergency call function.

The central processing device may not communicate with telephones registered for notification, but may notify cohabiters in the same residence. In this case, a sound signal from the terminal is not transmitted to the external telephones but is amplified and outputted from the voice output unit 12*a* of the central processing device 10. Thus, situation check of the user carrying the terminal 34 by sound can be performed in the central processing device 10. In this case, a sound signal is output from the voice input unit 12*b* of the central processing device 10 to the terminal 34. Hence, the user carrying the terminal 34 can be called on by sound from the central processing device 10.

When receiving a signal representing occurrence of emergency situation from the terminal 34, the central processing device 10 may instruct at least one terminal except for the terminal 34 to generate a warning. In this case, it is designed that the warning is kept for a relative short time. Hence, attention of cohabiters in the same residence to the occurrence of emergency situation can be called.

The terminal with the sound communication function arranged therein can provide the following advantages in comparison with a conventional configuration in which only a central processing device has a sound communication function. A situation, which is desired to be known from the outside, corresponds to a situation near the site where a nonstationary state such as burglary occurs. There is no point in knowing the situation at a position near the central processing device. In this system, since threatening or calling on can be directly performed to the site where a nonstationary state occurs, an effect of suppressing the burglar from burglary on a residence can be achieved, and a sense of security given to a person who transmits an emergency call is improved. In particular, when the site where an emergency situation occurs is distant from the central processing device or is partitioned by a door, the present invention is very advantageous.

As described above, according to the monitoring system of this embodiment, the terminal and the central processing device or the terminal and a communication device such as an external telephone can communicate with each other with sound or voice. It is possible to threaten a burglar around the terminal with sound through the sound output means of the terminal having the burglary detection means, and to monitor a situation around the terminal with sound through the sound input means. Furthermore, it is possible to call on a user carrying the terminal with the emergency call means through the sound output means of the terminal, and check user's situation through the sound input means.

In this embodiment, the terminal and the external telephone or the terminal and the central processing device can communicate with each other with sound. However, depending on user's settings, the central processing device and the external telephone may be communicated with each other. In addition, when the terminal and the external telephone cannot communicate with each other due to breakdown of the terminal by the burglar, trouble of the terminal, voltage drop of the battery of the terminal, abnormality of communication between the terminal and the central processing device, or the like, the control may be automatically switched to make the central processing device communicate with the external telephone, or a warning from the central processing device can be generated or stopped by transmitting a predetermined tone signal from the external telephone.

When the burglary occurs or when the emergency call is generated, the controller 15 operates the external interface 13*c* to close the non-voltage contacts of the external devices connected to the external terminal 13*d* such as the monitoring camera 62, the internet camera 63, and the flash light 64 so that these external devices can be operated. Hence, video footage of the site where the burglary occurs can be captured by the monitoring camera 62, and recorded on a recording device which is additionally arranged. In addition, the burglary site or the site where the emergency situation occurs is photographed by the internet camera 63, and the video information is transmitted to the data server 75 through the internet. A center server records the information on a recording medium such as an internal hard disk and allows the information to be browsed on the WEB. Thus, the user can access the center server through the internet to browse the WEB to see the video footage of the area. The video footage of the site captured by the internet camera 63 may be transmitted to a predetermined address with an electronic mail. Furthermore, it is possible to flicker the flashlight 64 to notify neighbors of an occurrence of an abnormality or to threaten a burglar.

A predetermined tone signal may be transmitted from the telephone 71, 72 or 73 and received by the central processing device 10. In this case, when receiving the signal, the central processing device 10 may make the external devices such as the monitoring camera 62, the internet camera 63, and the flash light 64, connected to the external terminal 13*d*, operate or stop the operations thereof.

Illumination devices and home appliances in a residence may be used as the external devices connected to the external terminal 13*d*, and a predetermined tone signal may be transmitted from the telephone 71, 72 or 73 and received by the central processing device 10. In this case, when receiving the tone signal, the central processing device 10 may make the illumination devices or home appliances connected to the external terminal 13*d* operate so that a burglar may be threatened in response to a notice of burglary or camouflage may be performed as if a user is at home.

In addition, in order to check whether the terminal normally operates, the central processing device 10 periodically transmits an operation check signal to the terminal, and determines that the terminal is normal when it receives a predetermined normal operation signal from the terminal. If the predetermined normal operation signal cannot be received from the terminal, the central processing device 10 determines that the terminal is abnormal, records the history in the data storage unit 15*b*, and displays the history on the display of the operation unit 14.

Second Embodiment

Figure 5:
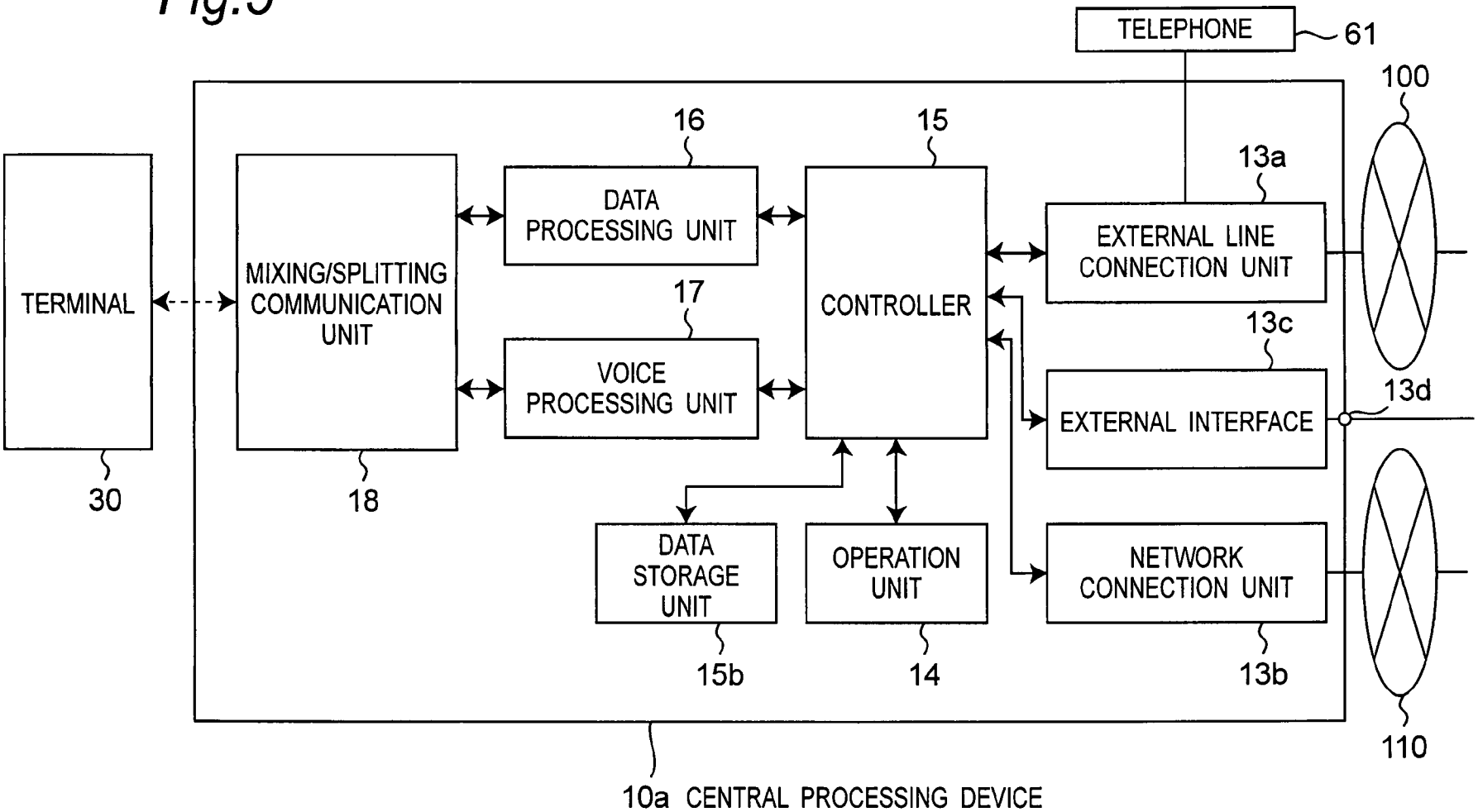
FIG. 5 is a diagram showing another example of the configuration of the central processing device.

FIG. 5 is a diagram showing another configuration of the central processing device 10 in the monitoring system. The second embodiment is different from the first embodiment in a communication method between a central processing device and a terminal. More specifically, in the first embodiment (see FIG. 2), the data and voice communication units 11 and 12 are independently arranged. In this embodiment, the communication units are integrated by multiplexing and separation of data and an audio signal.

In FIG. 5, a central processing device 10*a* according to the present invention includes a data processing unit 16 for processing data, a voice processing unit 17 for modulating and demodulating an audio signal, and a mixing/splitting communication unit 18 for multiplexing the data and the sound signal.

When data and an audio signal are transmitted from the central processing device 10*a*, the mixing/splitting communication unit 18 mixes data and an audio signal by frequency multiplexing and transmits the multiplexed signal. When data and an audio signal are received from the terminals 30, the mixing/splitting communication unit 18 separates the received signal into the data and the audio signal. Although the frequency multiplexing scheme is used as a multiplexing scheme, any scheme such as a time division multiplexing scheme or a coding/multiplexing scheme may be used. The execution of multiplexing and separation make it possible to share a high-frequency circuit for radio communication. The other constituent elements are the same as those in the first embodiment (see FIG. 2).

Figure 6:
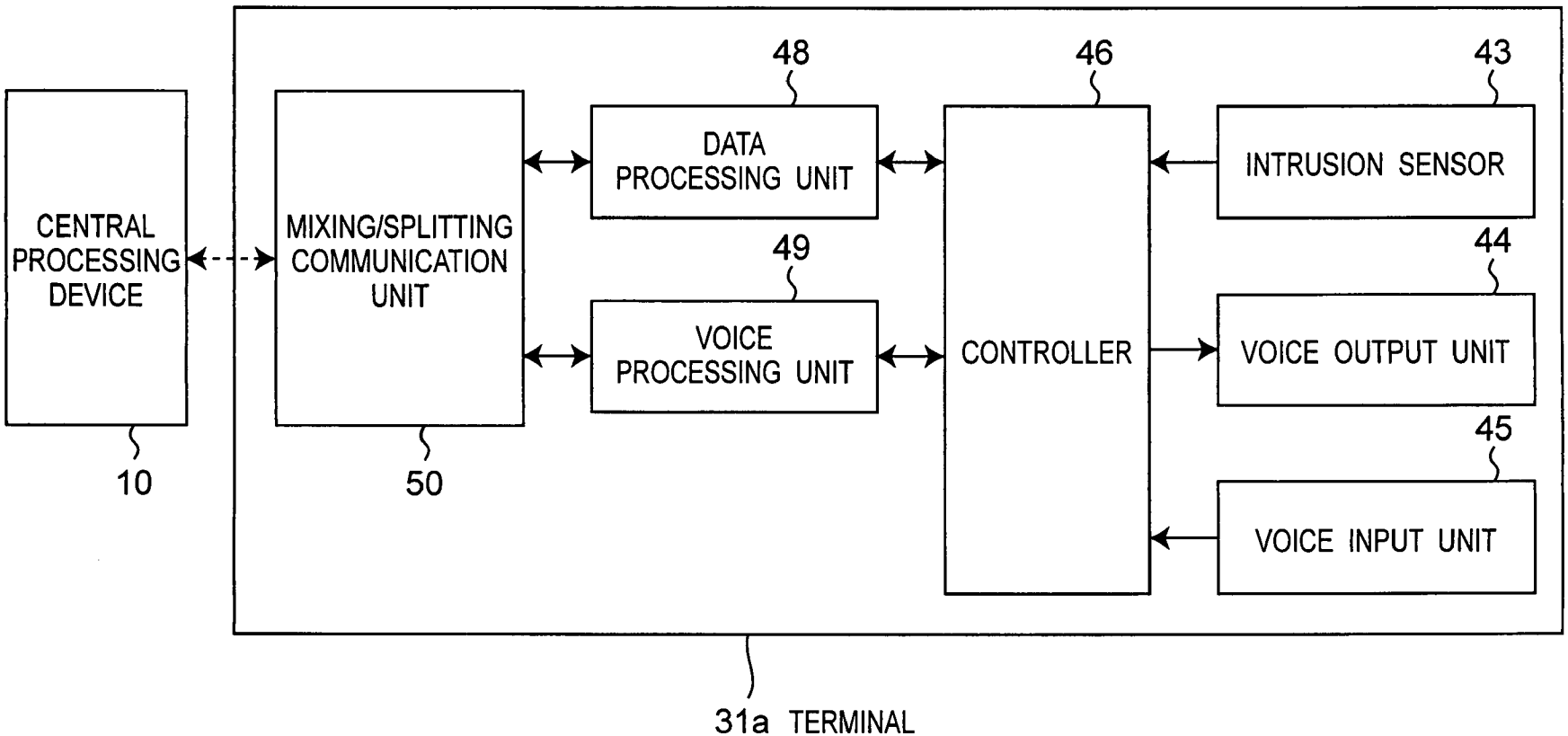
FIG. 6 is a diagram showing another example of the configuration of the terminal having the burglary sensor.

FIG. 6 is a block diagram showing another example of the configuration of the terminal 31 for detecting burglary. A terminal 31*a* according to this embodiment, in place of the data communication unit 41 and the voice communication unit 42, which are used in the configuration of the terminal 31 shown in FIG. 3, a data processing unit 48 for processing data, a voice processing unit 49 for modulating/demodulating an audio signal, and a mixing/splitting communication unit 50 for multiplexing data and an audio signal.

When a burglary sensor 43 in the terminal 31*a* detects an occurrence of a burglary, nonstationary state information consisting of a code representing an occurrence of a nonstationary state (occurrence of the burglary) and a terminal code of the terminal 31*a* is wirelessly transmitted to the central processing device 10*a* by the mixing/splitting communication unit 50 through the data processing unit 48.

The audio signal received from the central processing device 10*a* is separated by the mixing/splitting communication unit 50 of the terminal 31*a* and demodulated as an audio signal by the voice processing unit 49. The demodulated audio signal is amplified by the voice output unit 44 to output amplified sound. The sound generated around the terminal 31*a* and collected by the voice input unit 45 is modulated by the voice processing unit 49 and transmitted from the mixing/splitting communication unit 50 to the central processing device 10*a*.

The configuration of this embodiment can also be applied to the terminal for emergency call.

The embodiment is described by using a telephone or a public telephone network. However, a communication device such as a personal computer or a mobile information terminal may be used, or a leased circuit or the internet may be used.

As described above, according to the embodiment of the present invention, a high-frequency circuit required for data communication and voice communication can be shared.

Third Embodiment

In this embodiment, a system configuration in which it can be checked by a terminal whether a notice of occurrence of an emergency situation or an operation designation from the terminal by a user is safely accepted or not by an external telephone or a central processing device.

Figure 7:
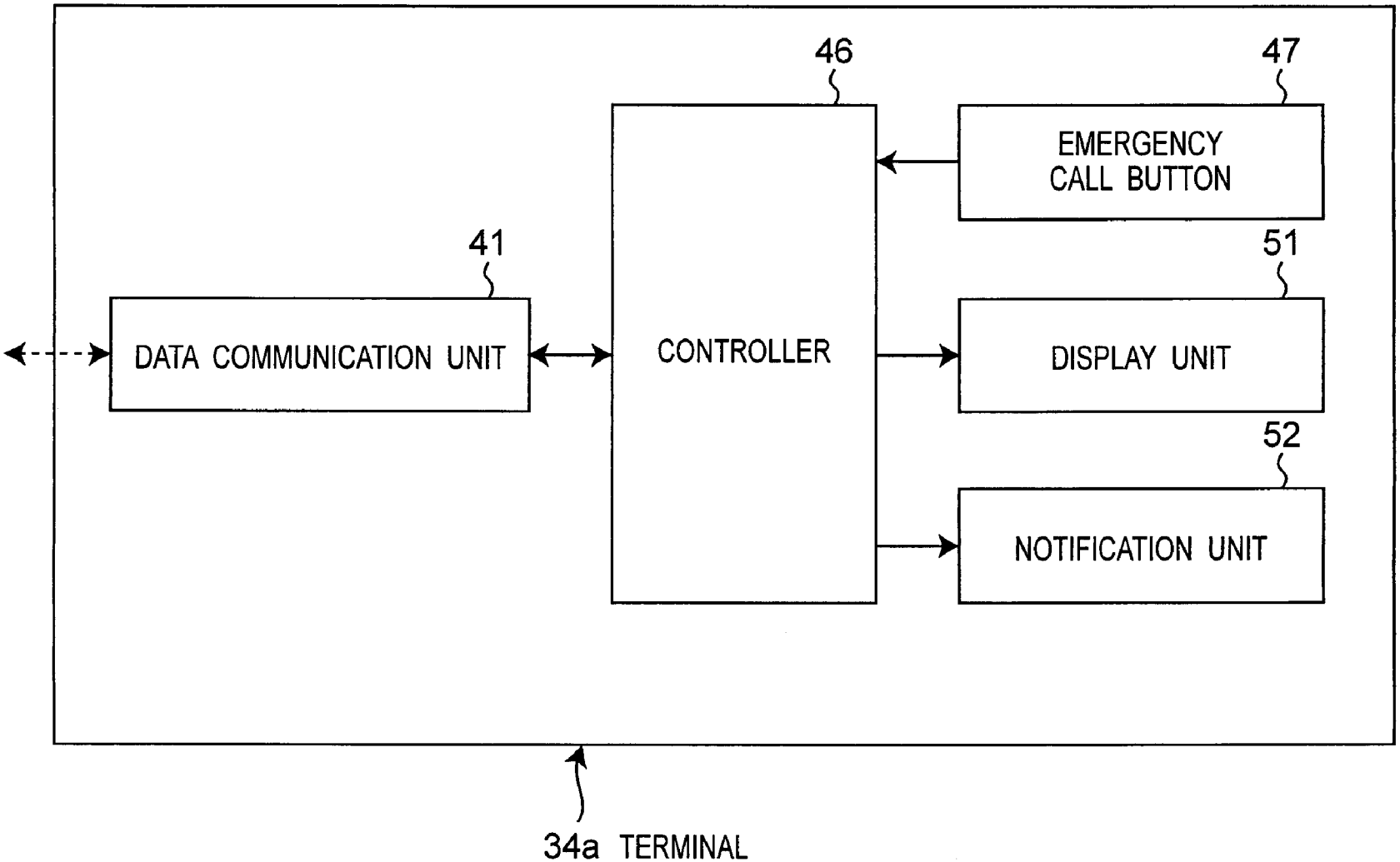
FIG. 7 is a diagram showing another example of the configuration of the terminal having the emergency call button.

FIG. 7 is a block diagram showing the configuration of a terminal on which an emergency call button is arranged. As shown in FIG. 7, a terminal 34*a* according to this embodiment includes a data communication unit 41, a controller 46, an emergency call button 47, a display unit 51, and a notification unit 52. The emergency call button 47 is arranged as a push button switch. A user depresses the push button switch to make it possible to notify occurrence of an emergency situation.

When the controller 46 receives a nonstationary state signal (signal representing that a user is in an emergency situation) from the emergency call button 47, and the controller 46 wirelessly transmits nonstationary state information including a terminal code and a state code to the central processing device 10 by using the data communication unit 41.

The display unit 51 constituted by a light-emitting means such as a LED, and flickers to notify a user of predetermined information. A notification unit 16 produces sound to notify the user of the predetermined information.

Figure 8:
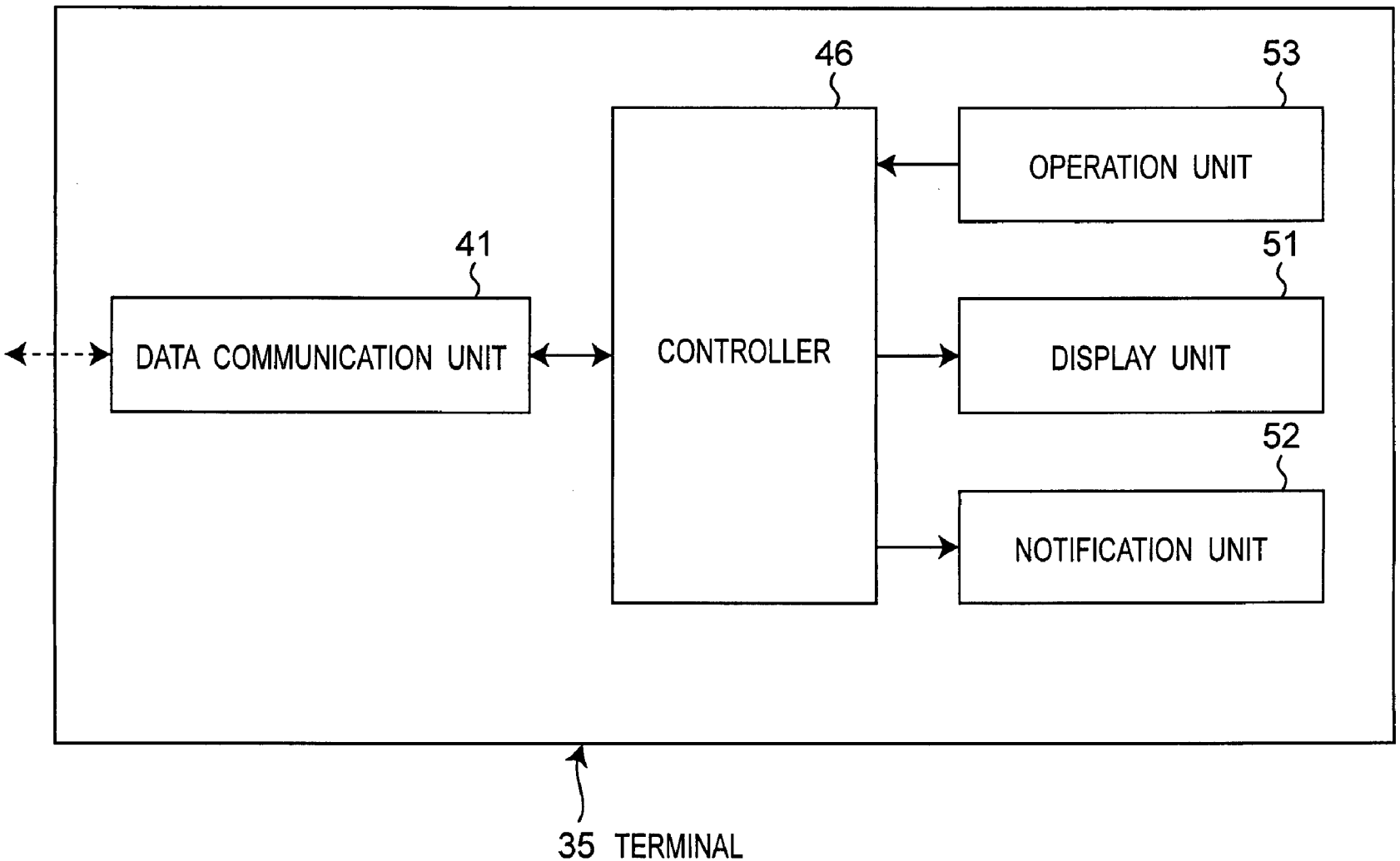
FIG. 8 is a diagram showing an example of the configuration of a terminal in which an operation unit remotely controls a central processing device.

FIG. 8 is a block diagram showing the configuration of a terminal including an operation unit for remotely controlling the central processing device 10. A terminal 35 includes a data communication unit 41, a controller 46, a display unit 51, a notification unit 52, and an operation unit 53 which can be remotely controlled. In this embodiment, the operation unit 53 includes a plurality of push button switches. A user depresses the push button switches to make it possible to remotely operate the central processing device 10. The "remote operation" mentioned here is an operation which controls the central processing device 10 to start a monitoring operation in a monitoring area or to cancel the monitoring operation. When the controller 46 receives an operation signal (signal representing that a user starts or stops the monitoring operation of the central processing device 10) from the operation unit 53, the controller 46 transmits a code corresponding to the operation signal from the data communication unit 41 to the central processing device 10 together with the own terminal code.

An overall operation of a monitoring system using the terminals 34*a* and 35 will be described below.

First, an operation related to an emergency call using the terminal 34*a* will be described below. If a burglary occurs which requires an urgent action with a user in the residence, or if the physical condition of the user suddenly changes to require outside contacts, when the user depresses the emergency call button 47 of the terminal 34*a*, the address code of the terminal 34*a* and a state code representing the occurrence of the emergency situation are transmitted to the central processing device 10. The central processing device 10 reads a voice message corresponding to the received state code of the occurrence of the emergency state from the data storage unit 15*b* and transmits the voice message to the telephone 71, 72 or 73 registered for notification through an external line connection unit 13*a*.

A contact person who receives the notice through the telephone 71, 72 or 73 transmits a predetermined tone signal from the telephone 71, 72 or 73 to notify the user that the contact person to be notified has confirmed the occurrence of burglary. The central processing device 10 receives this signal through the external line connection unit 13*a*, and transmits an acceptance confirmation signal, which is a signal representing that the contact person to be notified confirms the occurrence of the emergency situation in a monitoring area, from the data communication unit 11 to the terminal 34*a*. The terminal 34*a* receives the acceptance confirmation signal at the data communication unit 41 and causes the display unit 51 to flicker for a predetermined period of time in response to the acceptance confirmation signal, and, at the same time, causes the notification unit 52 to produce sound. Thus, the user can recognize that the emergency call is confirmed by the contact person to be notified who goes out.

In this embodiment, both the display unit 51 and the notification unit 52 are arranged in the terminal 34*a*. However, any one of the display unit 51 and the notification unit 52 may be arranged as needed. Although the contact person transmits the tone signal to give confirmation of receiving a notice of the occurrence of the emergency situation, even though information representing that an external telephone is completely connected may be used, the same effect as described above can be obtained. The confirmation of reception may also be performed by transmission of an electronic mail using another communication device such as a mobile telephone.

As described above, when a terminal receives a signal representing that information of the occurrence of a nonstationary state is confirmed by an out-of-residence communication device, the display unit of the terminal flickers for a predetermined period of time, or the notification unit thereof produces sound for a predetermined period of time. In this manner, a user of the terminal can know that the information of the occurrence of the nonstationary state is safely confirmed by the out-of-residence communication device.

An operation related to a remote operation for setting/canceling an alarm operation using the terminal 35 will be described below. A user can perform remote operation for setting/canceling the alarm operation with the operation unit 53 of the terminal 35. When the user sets/cancels the alarm operation with the operation unit 53 of the terminal 35, an operation code corresponding to a setting/canceling command of the alarm operation which is a content of an operation input and the address code of the terminal 35 are transmitted to the central processing device 10.

On the basis of the reception of these codes, the central processing device 10 transmits the setting/canceling command of the alarm operation to all the terminals except for the terminal 35 in which the input operation has been performed. When the central processing device 10 completes the process of setting/canceling the alarm operation, an operation acceptance confirmation signal representing that a process for the operation code is completed is transmitted from the data communication unit 11 to the terminal 35. When receiving this signal, the terminal 35 causes the display unit 51 to flicker for a predetermined period of time, and, at the same time, causes the notification unit 52 to produce sound for a predetermined period of time. Thus, the user can confirm that the remote operation is accepted by the central processing device 10.

In this embodiment, both the display unit 51 and the notification unit 52 are arranged in the terminal 35. However, any one of the display unit 51 and the notification unit 52 may be arranged as needed.

The following application may be achieved. The central processing device 10 stores state information transmitted from a terminal 31 including the burglary sensor to the data storage unit 15*b*. When receiving information for alarm setting from the terminal 35 having the operation unit 53 and if the state information stored in the terminal 31 represents "open", the central processing device 10 displays indication of abnormal door-lock check on the display panel of the operation unit 14 and transmits a signal of abnormal door-lock check to the terminal 35 having the operation unit 53. When the terminal 35 receives the door-lock check abnormal signal, the terminal 35 notifies the user that the door-lock check is abnormal.

As described above, in this embodiment, a command for setting/canceling an alarm operation can be sent from the terminal to the central processing device with a remote operation. In addition, the acceptance confirmation function provided to the terminal also achieves the following advantage. A position, where a fact that an operation performed by a user is accepted is desired to be confirmed, corresponds to a site where a nonstationary state occurs or where a remote operation is performed, that is, there is little point in that the fact can be confirmed near the central processing device. In addition, since operation acceptance can be confirmed at the site where the nonstationary state occurs, a sense of security given to a person who transmits an emergency call is improved, and convenience for a user who performs the remote operation is improved. In particular, the present invention is very advantageous when the site where the remote operation is performed is distant from the central processing device or is partitioned by a door.

In this embodiment, the remote operation sets and cancels a monitoring operation for the central processing device. However, another remote operation such as a remote operation for turning on/off the power supply of the central processing device can achieve the same effect as described above. Furthermore, a remote operation for controlling an operation of another device related to the central processing device with a wireless system or a wired system can also achieve the same effect as described above.

As described above, according to the present invention, a display means is provided to a terminal having an emergency call means or an operation input means, so that out-of-residence acceptance of an emergency call or appropriate completion of an operation input can be visually achieved at hand to improve a sense of security or operationality. In addition, a notification means is provided to a terminal having an emergency call means or an operation input means is arranged, so that out-of-residence acceptance of an emergency call or appropriate completion of an operation input can be visually achieved at hand to improve a sense of security or operationality. These display means and the notification means are properly selected depending on sensory function of a user, and thus good adaptability for the aged can be achieved.

Fourth Embodiment

A monitoring system according to this embodiment makes it possible to perform warning and threatening operations on a terminal by a central processing device when a notice of occurrence of a nonstationary state is transmitted from the terminal to the central processing device.

Figure 9:
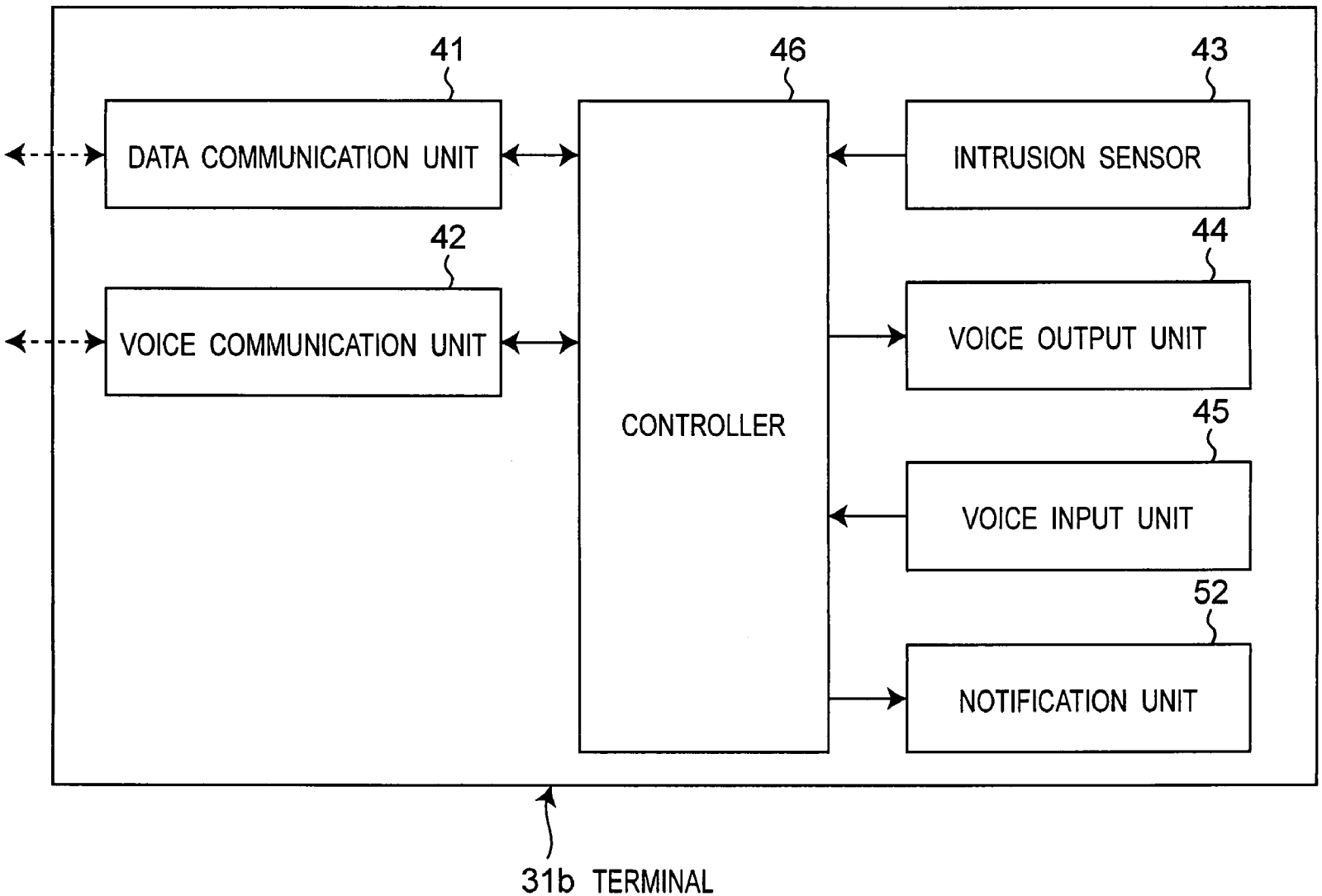
FIG. 9 is a diagram showing still another example of the configuration of the terminal having the burglary sensor.

FIG. 9 is a block diagram showing an example of the configuration of a terminal having a burglary detection function according to this embodiment. A terminal 31*b* includes a data communication unit 41, a voice communication unit 42, a burglary sensor 43, a voice output unit 44, a voice input unit 45, a controller 46, and a notification unit 52. The notification unit 52 performs notification by a voice or flickering of a LED.

Figure 10:
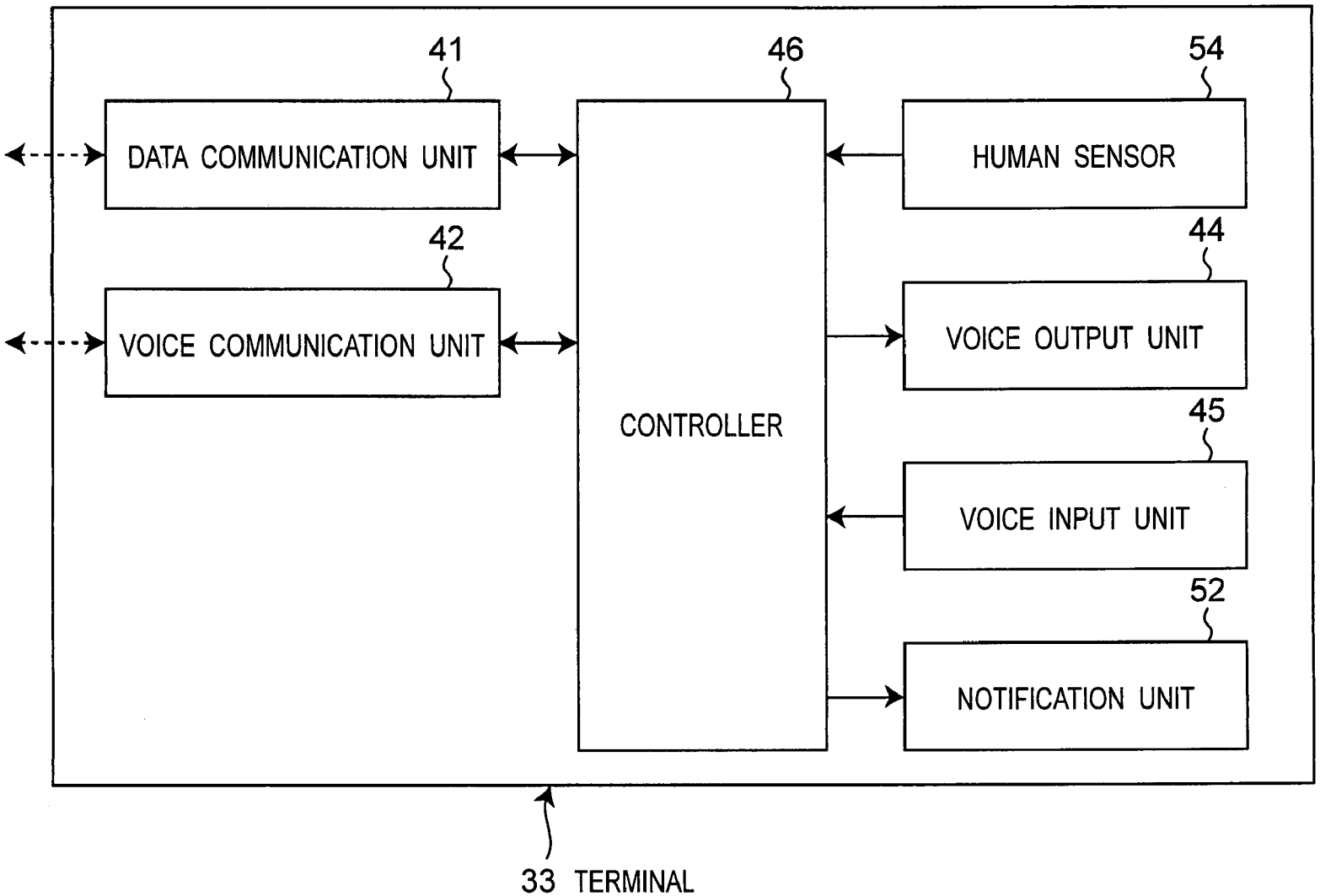
FIG. 10 is a diagram showing an example of the configuration of a terminal having a human sensor.

FIG. 10 is a block diagram showing an example of the configuration of a terminal having a function of detecting the presence of a person in this embodiment. The terminal 33 includes a data communication unit 41, a voice communication unit 42, a voice output unit 44, a voice input unit 45, a controller 46, a notification unit 52, and a human sensor 54. The human sensor 54 is constituted by a pyroelectric infrared sensor, so that the terminal 33 has a function of detecting the presence of a human body. When the terminal 33 is fixed on an area, a burglar entering the area can be detected. When the human sensor 54 detects the burglar, a nonstationary state signal (signal representing that a burglar is present) is output to the controller 46. When receiving this signal, the controller 46 wirelessly transmits nonstationary state information including the own terminal code to the central processing device 10 through the data communication unit 41.

Figure 11:
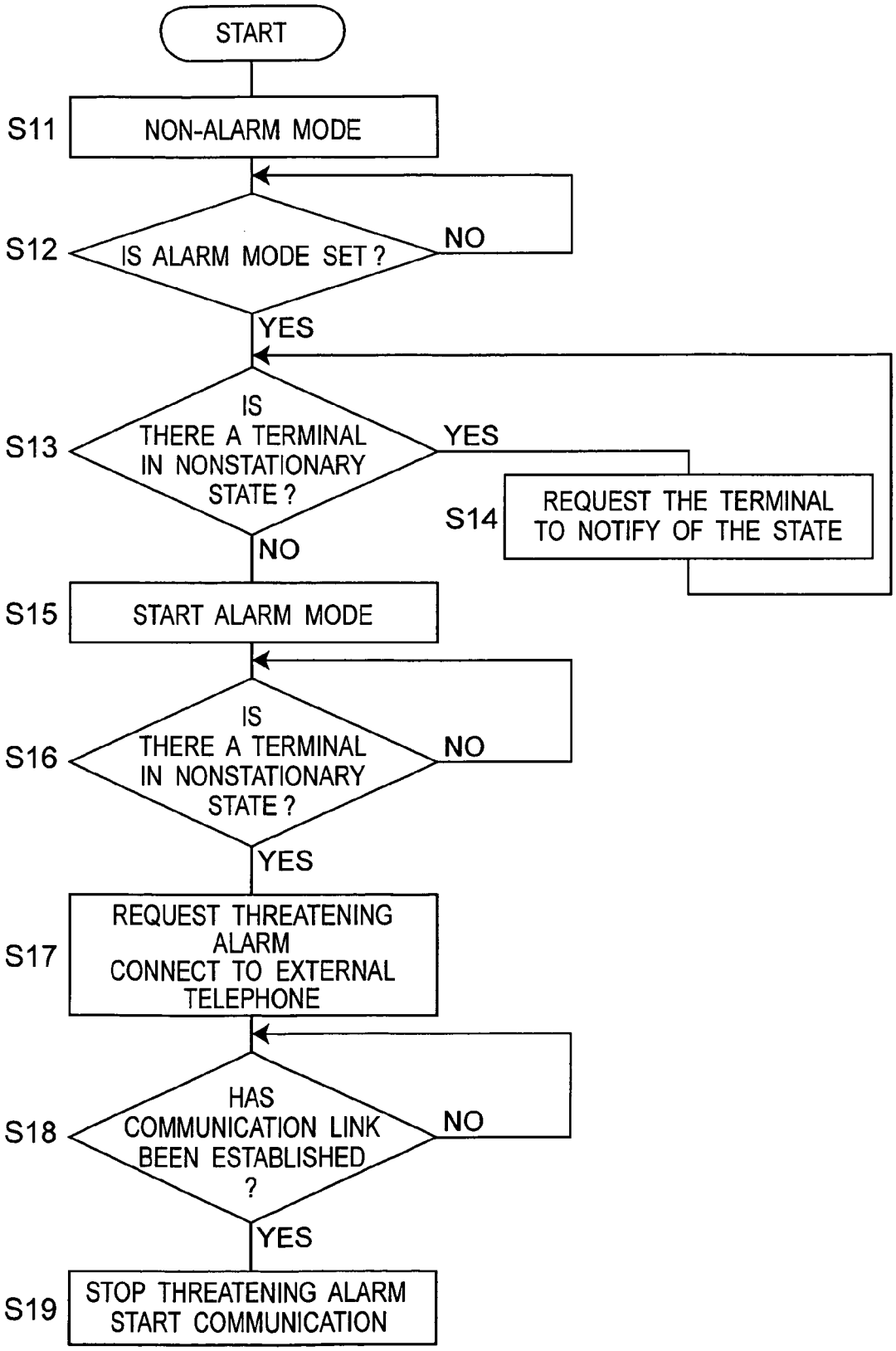
FIG. 11 is a flow chart of an alarm operation of the central processing device.

The operation of the monitoring system according to this embodiment will be described below with reference to the flow chart in FIG. 11.

When an alarm mode is set on the operation unit 14 of the central processing device 10 by a user who will go out (S11 and S12), a check request signal for checking the presence of a terminal set in a nonstationary state is transmitted from a data communication unit 11 of the central processing device 10 to the respective terminals 31-35 (S13).

In each of the terminals 31-35, when the data communication unit 41 of each of the terminals 31-35 receives the check request signal, the output states of the burglary sensor 43 and the human sensor 54 are checked by the controller 46. When the terminals 30 confirms a stationary state such as a state in which a window and a door at a monitoring position are closed or in which a hallway is clear, the controller of the terminals 30 transmits a state confirmation signal representing a stationary/nonstationary state to the central processing device 10. When receiving the state confirmation signal from the terminal, the central processing device 10 returns a notification reset signal to the terminal. When receiving the notification reset signal, the terminal completes the transmission of the state confirmation signal. When the terminal cannot receive the notification reset signal from the central processing device 10, it repeats the transmission of the state confirmation signal a predetermined number of times.

When the central processing device 10 confirms that all the terminals 31-35 are in stationary states by the state confirmation signals received from the terminals 31-35 (No in S13), the central processing device 10 starts an alarm operation (S15).

On the other hand, when at least one of all the terminals is in a nonstationary state, e.g., when a window or a door at the monitoring position is open or when a curtain stirs and enters the hallway due to wind blowing, a state confirmation signal representing the nonstationary state is transmitted to the central processing device 10. When the central processing device 10 confirms a certain terminal is in a nonstationary state, the start of the alarm operation is reserved. The central processing device 10 transmits a notification request signal to the terminal in the nonstationary state to notify a user of the nonstationary state (S14).

When receiving the notification request signal from the central processing device 10, the terminal operates the notification unit 52 to generate a warning, and, at the same time, cause a LED to flicker. The user hears this warning or sees the flickering LED to specify a window on which the nonstationary state is detected, and closes the window. Thus, the terminal outputs the state confirmation signal representing the nonstationary state and outputs a state confirmation signal representing a stationary state, and the monitoring state is set in a stationary state. The volume of the warning is set to be lower than that of a warning generated when a nonstationary state is detected in an alarm operation. As described above, all the terminals are in stationary states (S13), the terminals are set in alarm operations on the basis of the above procedure to start alarm operations (S15).

Even though the monitoring position is not easily recognized by a warning sound or flickering of the LED, a voice communication between the terminals 31-35 and the central processing device 10 can be established through the voice communication units 42 of the terminals 31-35 and the voice communication unit 12 of the central processing device 10. Thus, a person on the central processing device 10 can communicate with a person on the terminal side on the basis of information of the installation location of terminals that is registered in the central processing device 10 in advance to notify the person on the terminal side of the installation location of the terminal, so that the monitoring position can be checked.

On the basis of installation location information of terminals registered in an data storage unit 15*b*, the installation location of a terminal in a nonstationary state is transmitted as voice data from the central processing device 10 to the voice communication units 42 of the terminals 31-35. Thus the terminals can notify a user of the installation location information of the terminal in the nonstationary state with sound or voice. A person on the terminal side can check the monitoring position on the basis of contents of the voice notification.

When the central processing device 10 confirms that all the terminals are in stationary states, it transmits commands for setting the alarm operation to the terminals in order to start alarm operations (S15). When receiving the command for setting the alarm operation, the terminal starts to shift to an alarm state, and transmits a shift confirmation signal representing that the terminal starts to shift to the alarm state to the central processing device 10. When receiving the shift confirmation signal, the central processing device 10 completes the transmission of the commands for setting the alarm operations. At this time, the central processing device 10 repeats, a predetermined number of times, transmission of a command for setting an alarm operation to terminals from which the shift confirmation signals are not received. When there are some terminals from which the shift confirmation signal cannot be received even though the central processing device 10 repeats the transmission of the setting commands a predetermined number of times, the central processing device 10 stores an operation history, indicating an abnormal device, in the data storage unit 15*b*.

When a nonstationary state occurs in a terminal in the alarm operation, the terminal transmits nonstationary state information to the central processing device 10 as described above. For example, if a window or a door, on which a terminal having a burglary sensor is installed, is opened, the terminal transmits the nonstationary state signal to the central processing device 10. When receiving the information, the central processing device 10 determines the specific terminal from which the signal is transmitted, and recognizes the occurrence of the burglary (S16). On the basis of the information, the central processing device 10 transmits a notification request signal to the specific terminal to provide notification for threatening (S17).

When the terminal receives the notification request signal from the central processing device 10, the terminal operates the notification unit 52 to perform notification for threatening. In a threatening method, the length of threatening time, the sound volume of the threatening operation, the threatening contents, and the like can be selected in advance. As the threatening contents, a siren generally wails. However, sound data "who is it!" may be stored in the terminal or the central processing device 10, and the sound data may be called and used in notification.

The central processing device 10 accesses the fixed telephone or the like 71, 72 or 73 corresponding to telephone numbers which are registered in advance to transmit a voice message for notifying a user of the name of a location where the burglary occurs and the occurrence of the burglary in addition to a threatening notification request (S17).

A user who receives the notice via the telephone 71, 72 or 73 transmits a predetermined tone signal representing acknowledgement of the notification, from the telephones 71, 72 or 73 to the central processing device 10. The central processing device 10 transmits a common call signal to a plurality of terminals. In the terminal which transmits a nonstationary signal, a voice communication unit is set in a standby state in advance. When the voice communication unit receives the common call signal from the voice communication unit of the central processing device 10, the voice communication unit of the terminal is operated to establish a voice communication link between the terminal and the telephones 71, 72 or 73 (S18). Hence, sound or voice around the terminal can be monitored by the telephones 71, 72 or 73 through a voice input unit 24, and the situation around the terminal can be monitored (S19). When the voice communication link is established, the central processing device 10 transmits a notification stop signal to the terminal, and the notification for threatening is ended (S19).

If necessary, the user can threaten a burglar with user's voice from the voice output unit of the terminal through the telephones 71, 72 or 73.

In the above description, the notification for threatening is ended by establishing the voice communication link. However, the central processing device 10 may transmit a notification stop signal, to end the notification for threatening, to the terminal, when receiving a tone signal for requesting the stop of warning from the telephones 71, 72 or 73.

The central processing device 10 may transmit a notification start signal, to start the notification for threatening, to the terminal, when receiving a tone signal for requesting the start of warning from the telephones 71, 72 or 73. Thus, the user can threaten the burglar by transmitting the predetermined tone signal while monitoring the situation around the terminal if necessary.

When an at home alarm mode is set when a user is in the home and is asleep at night, if the burglary occurs, an audio signal from the terminal is not transmitted to an external telephone but amplified and output from the voice output unit 12*a* of the central processing device 10. Thus, a situation obtained by sound or voice around the terminal can be monitored by the central processing device 10. In this case, the audio signal can also be output from the controller 15 of the central processing device 10 to the corresponding terminal. Thus, the central processing device 10 can cause the terminal to threaten a burglar by sound or voice. In this case, notification for threatening is continuously performed by the terminal until voice communication between the terminal and the central processing device 10 is established.

It is noted that the terminal 33 having the human sensor 54 is controlled in the same manner as that of the terminal 31*b* having the burglary sensor 43.

The operation performed in the setting operation for the alarm operation has been described above. However, the alarm operation can be also canceled by the operation unit 14 of the central processing device 10. When a user conducts a setting for canceling the alarm operation, commands for canceling the alarm operations are transmitted from the central processing device 10 to the terminals 30. When the terminals receive canceling commands, the terminals shift to alarm canceling states.

In the above example, when all of the terminals are set in stationary states, an alarm mode is started (see steps S13 and S15), some terminal may not be immediately set in a stationary state in such a case that the battery runs out. In such a case, before all the terminals are set in stationary states, an alarm operation may be set for a terminal in the stationary state. The state of the terminal which cannot be set in an alarm operation is checked at predetermined intervals (e.g., 5 minutes). When the terminal does not become in the stationary state even though an attempt to set the terminal in the stationary state has been executed a predetermined number of times (e.g., three times), it is determined that the device is abnormal, and history information indicating that the device is abnormal may be recorded on the central processing device 10. As will be described below, the history information may be recorded on a predetermined server connected to the central processing device 10 through the internet 110.

As described above, when the terminal detects a nonstationary state, the central processing device controls the terminal to perform notification for threatening, so that a burglar can be threatened from the terminal at a location where the burglary occurs. Accordingly, the burglar can be threatened on an early stage of burglary, and an effect of suppressing burglary is improved.

In the above example, when commands for canceling alarm operations are transmitted from the central processing device 10 to the terminals 30, the terminals 30 shift to alarm canceling states, in response to the alarm canceling commands, and transmit shift confirmation signals, representing that the terminals are to shift to the alarm canceling states, to the central processing device 10. When receiving the shift confirmation signals, the central processing device 10 completes the transmission of the commands for canceling the alarm operations. However, when the communication is established with all the terminals 30 in the above described manner, it takes a long time to complete the communication with all the terminals and some terminals cannot cancel its alarm operation. When a terminal has, e.g., a human sensor, the terminal disadvantageously generates a warning for user's who approach the terminal. Therefore, when the central processing device 10 outputs the command for canceling the alarm operation, simultaneous transmissive communication of commands may be performed such that the alarm operations of the terminals 30 can be canceled at once and all the terminals 30 are temporarily shifted to the alarm canceling states. In this case, the shift confirmation signals may not be returned from the terminals 30 to the central processing device 10. In this case, as described above, the central processing device 10 temporarily performs simultaneous transmissive communication of alarm cancellation to shift the terminals 30 to the alarm canceling states. Thereafter, confirming operations are performed by the terminals 30 by mutual communication to check sequentially whether each terminal 30 shifts to the alarm canceling state. This can improve both the convenience and reliability of the alarm cancellation.

An operation related to an emergency call will be described below.

Figure 12:
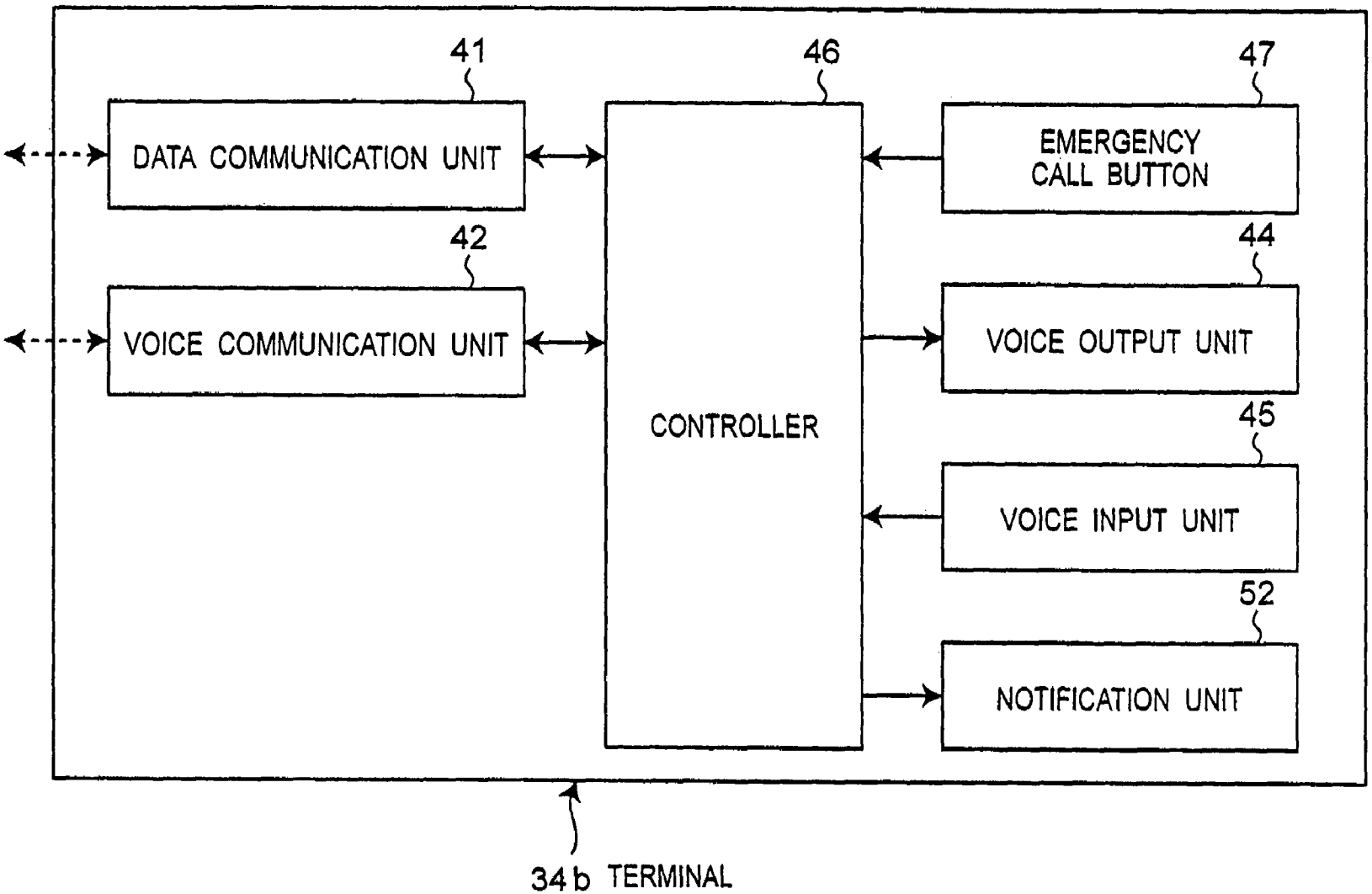
FIG. 12 is a diagram showing another example of the configuration of the terminal having the emergency call button.

FIG. 12 is a block diagram showing an example of the configuration of a terminal having an emergency call function in this embodiment. A terminal 34*b* includes an emergency call button 47, a data communication unit 41, a voice communication unit 42, a voice output unit 44, a voice input unit 45, a controller 46, and a notification unit 52. The functions of these units are the same as those described above.

When a user carrying the terminal 34*b* shown in FIG. 12 depresses the emergency call button 47 of the terminal 34*b* in an emergency, the address code of the terminal 34*b* and a state code representing occurrence of an emergency situation are transmitted to the central processing device 10 as a signal representing an occurrence of the emergency situation. The terminal 34*b* transmits the signal representing the occurrence of the emergency situation and then sets the voice communication unit 42 in a standby state.

The central processing device 10 refers to the data storage unit 15*b* on the basis of the codes received from the terminal 34*b*, retrieves a voice message corresponding the received codes, and transmits the message to the telephones 71, 72 or 73 registered for notification.

A contact person who receives the message through the telephones 71, 72 or 73 transmits a predetermined tone signal to the central processing device 10 through the telephones 71, 72 or 73. In the terminal 34*b* which transmits a signal representing the occurrence of the emergency situation, the voice communication unit 42 is set in a standby state. When receiving a call signal from the voice communication unit 12 of the central processing device 10, the terminal 34*b* operates the voice communication unit 42 of the corresponding terminal. Thus, the voice of a user carrying the terminal 34*b* can be monitored by the telephones 71, 72 or 73 through the voice communication unit 12 of the central processing device 10 and the contact person can confirm the current status. If necessary, the user in the emergency state can be called using the voice of the person to be notified output from the voice output unit 44 of the terminal 34*b* through the telephone 71, 72 or 73.

After the terminal 34*b* transmits a signal representing the occurrence of the emergency situation, the terminal 34*b* makes the LED of the notification unit 52 flicker or makes the voice output unit 44 generate sound (beep) until the communication between the terminal 34*b* and the central processing device 10 or the telephones 71, 72 or 73 is established. Thus, a sense of security can be given to the user, or the burglar can be threatened.

The central processing device may communicate not only with telephones registered for notification in the setting, but also with cohabiters in the same residence. In this case, an audio signal from the terminal is not transmitted to the external telephone but is amplified and output by a voice output unit 12*a* of the central processing device 10. Thus, a situation check by sound or voice can be performed in the central processing device 10 by the user carrying the terminal 34*b*. In this case, an audio signal is output from the voice input unit 12*b* of the central processing device 10 to the terminal 34*b*. Thus, the user carrying the terminal 34*b* can be called on by voice from the central processing device 10.

As described above, the terminal can communicate with the central processing device or a telephone registered in advance. When a nonstationary state is detected by the terminal, the terminal performs notification for threatening until the voice communication link between the terminal and the central processing device or the telephone is established, so that a situation around the terminal can be monitored by the central processing device or the external telephone registered in advance. Accordingly, the situation of the site can be recognized from a remote position, the voice communication can be performed, and therefore, the burglar can be threatened with sound from a remote position.

When voice data stored in advance in the terminal or the central processing device is used for notification for threatening, the user can obtain a sense of security since the voice data stored in advance can be used in place of users voice, if the user hesitates threatening directly performed with user' voice via the voice communication to the terminal at a remote position.

The voice data stored for threatening in the above example may be expressed in various dialects. Thus, threatening in consideration of regional characteristics can be achieved.

The voice data stored for threatening may be expressed in at least one foreign language. Thus, a foreign burglar can be effectively threatened, and the system can be used in a foreign country.

The voice data stored for threatening may be voice data for calling someone on a telephone. Since the voice data notifies the burglar that someone contacts a person out of the residence, the burglar can be effectively threatened.

The voice data for threatening may be generated on the basis of sound around the terminal or voice of the burglar. Threatening can be performed depending on a situation of the burglary, and the burglar is not needlessly excited.

When the terminal detects a nonstationary state, the terminal may store sound around the terminal. Thus, the burglary history is recorded, and then the history can be used in police investigation.

As described above, according to the monitoring system of this embodiment, when the terminal detects a nonstationary state, the central processing device causes the terminal to perform notification for threatening or controls the length of threatening time, the sound volume of the threatening operation, the threatening contents, and the like to directly perform the threatening operation from the terminal which detects occurrence of burglary. Accordingly, the burglar can be threatened at an early stage of the burglary, and the burglary can be effectively suppressed.

Fifth Embodiment

In this embodiment, the configuration of a monitoring system for autonomously performing an alarm operation when a terminal detects a nonstationary state will be described below.

Figure 13:
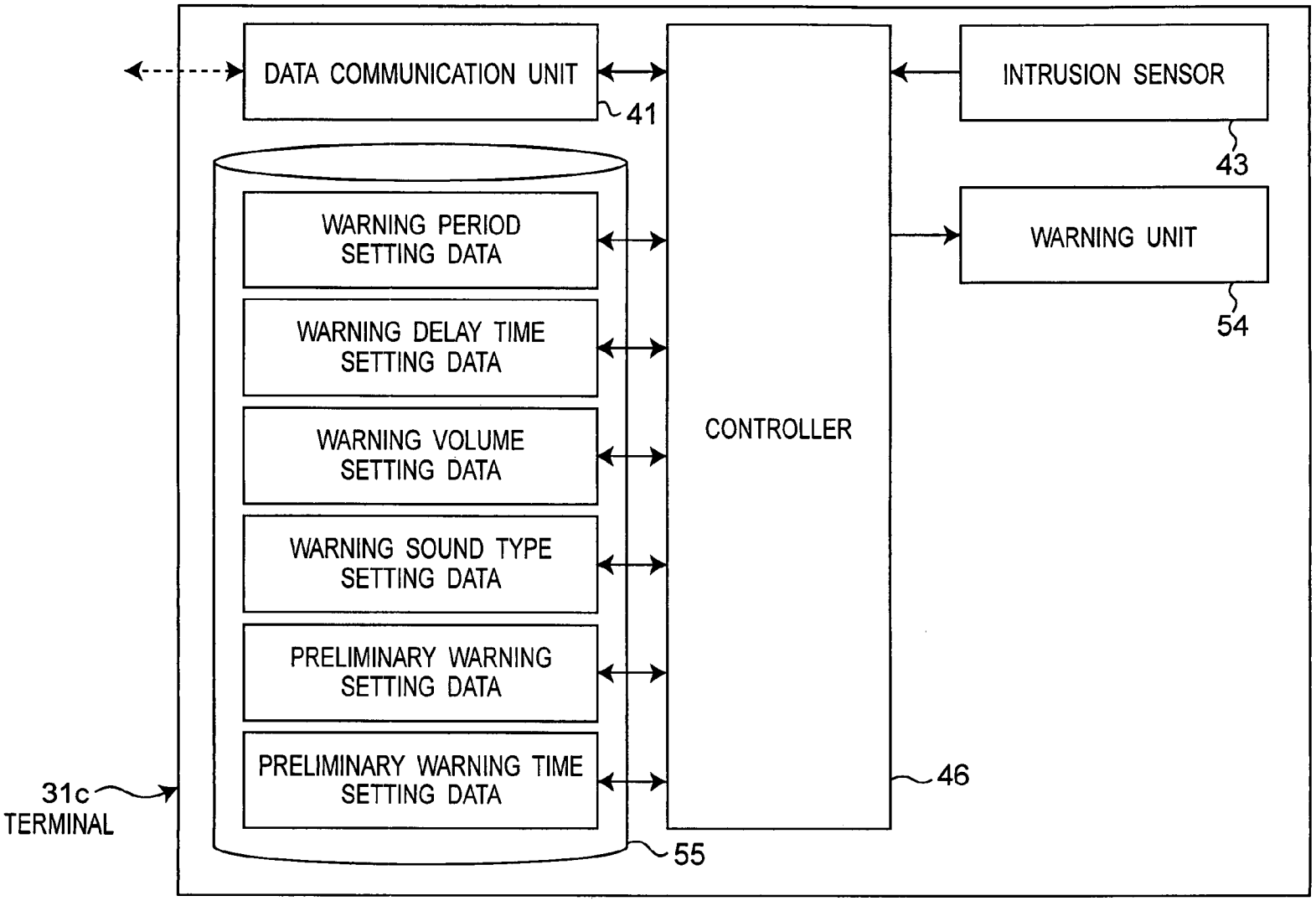
FIG. 13 is a diagram showing still another example of the configuration of the terminal having the burglary sensor.

FIG. 13 is a block diagram showing the configuration of a terminal having a burglary sensor in this embodiment. A terminal 31*c* includes a data communication unit 41, a burglary sensor 43, a controller 46, a warning unit 54, and a data storage unit 55.

When the controller 46 receives a command for starting an alarm operation from the central processing device 10 through the data communication unit 41, the controller 46 autonomously starts the alarm operation as a terminal. When the controller 46 receives a nonstationary state signal from the burglary sensor 43, the controller 46 generates a warning by itself through the warning unit 54 according to a procedure to be described later, and transmits nonstationary information including the own terminal code and a code representing occurrence of a nonstationary state, to the central processing device 10.

The warning unit 54 is constituted by a buzzer capable of producing loud sound.

The data storage unit 55 stores information related to various settings related to a warning. More specifically, the data storage unit 55 stores a set value of time (duration) of the warning and a set value of delay time from when occurrence of burglary is detected by the burglary sensor 43 to when the warning is actually generated. The warning delay time is required for the following reason. For example, when the burglary sensor 43 is installed on an entrance door, a burglary is detected even though a user opens the door when coming back home. In this case, if the warning delay time is not set, a warning is immediately generated disadvantageously.

Furthermore, the data storage unit 55 stores a set value of the sound volume of the warning unit 54, a setting of a type (e.g., continuous sound or intermittent sound) of sound of the warning unit 54, a setting of preliminary warning, and a set value of continuous time of the preliminary warning. In this case, the setting of the preliminary warning is a setting for determining whether the preliminary warning for immediately attracting attention is performed or not when the burglary sensor 43 detects occurrence of burglary. This preliminary warning is generated after the occurrence of burglary for only a relatively short time before a serious warning is generated to attract attention without a delay time, so that a threatening function which more quickly discourages the burglar can be achieved. The volume of the preliminary warning, the type of warning sound, and the like may be preferably different from those in a normal alarm operation.

Figure 14:
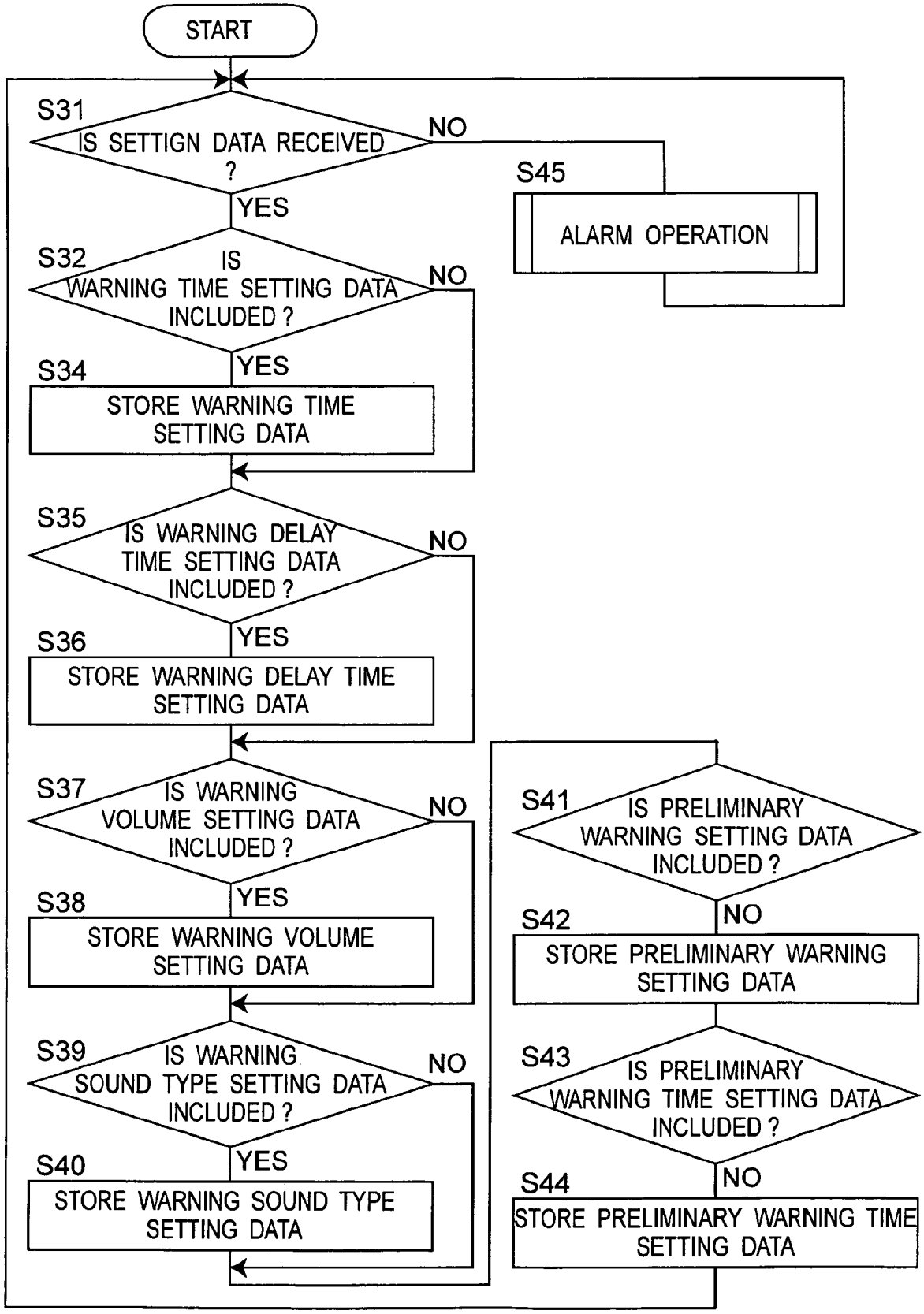
FIG. 14 is a flow chart of an operation (mainly, a setting operation of alarm setting data) of the terminal.
Figure 15:
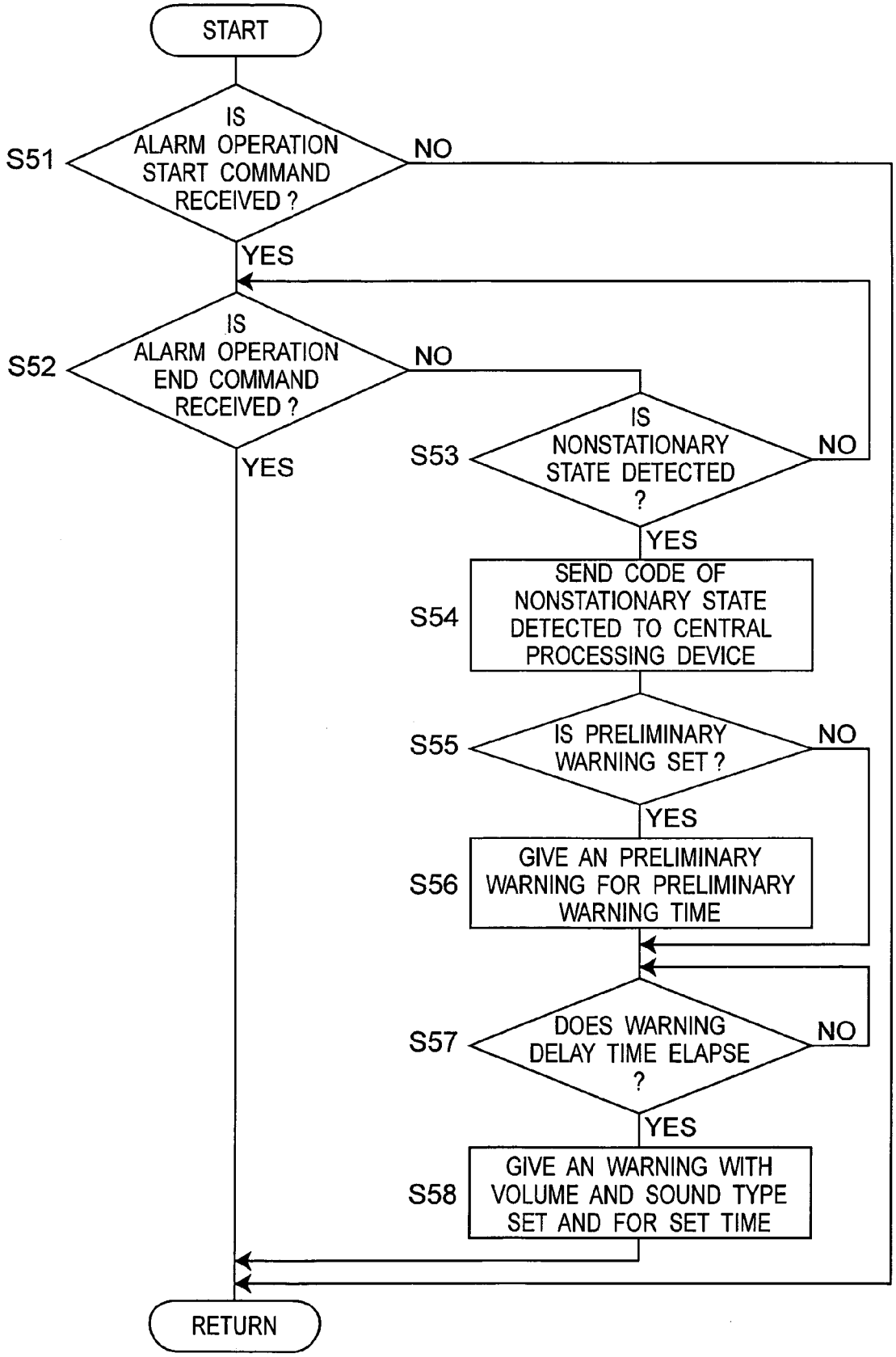
FIG. 15 is a flow chart of an alarm operation of the terminal.

A setting operation and an alarm operation of the terminal 31*c* will be described below by using the flow charts in FIGS. 14 and 15.

Setting for set values of the terminal 31*c* is executed such that setting information is transmitted from the central processing device 10 to a designated terminal by wireless communication in an initial setting or the like of the terminal 31*c*. As shown in FIG. 14, when the terminal 31*c* receives the setting information from the central processing device 10 (S31), the terminal 31*c* reads various set values included in the received setting information and stores the set values (i.e., warning time, warning delay time, sound volume of warning, type of warning sound, preliminary warning setting, and set value of preliminary warning time) in a predetermined region of the data storage unit 55 (S32 to S44).

When the terminal 31*c* does not receive the setting information from the central processing device 10, the terminal 31*c* performs an alarm operation process (S45). The alarm operation process will be described below with reference to FIG. 15.

The alarm operation is started when the user turns on the operation unit 14 of the central processing device 10. When the alarm operation is set on the operation unit 14, after a predetermined period of time elapses, the central processing device 10 transmits a command to a terminal as an alarm target via wireless communication to perform an alarm operation. The reason why the command of the alarm operation is transmitted to the terminal after the predetermined period of time elapses is because the user who performs the setting is prevented from being erroneously detected. When the terminal as the alarm target receives the command (S51), the terminal starts an autonomous alarm operation such that various decisions are performed by the terminal itself.

For example, in the alarm operation, one of a window and a door in which terminals 31*c* are installed is opened, the burglary sensor 43 detects a nonstationary state (S53). At this time, a signal representing an occurrence of the nonstationary state is output to the data communication unit 41. When receiving this signal, the data communication unit 41 sequentially transmits the own address code and a state code representing the occurrence of the burglary to the central processing device 10 (S54).

The central processing device 10 receives the transmitted signal, decides a specific terminal which transmits the signal, and recognizes the occurrence of the burglary. The central processing device 10 accesses a telephone or a mobile telephone corresponding to a telephone number for a contact registered in advance and transmits a voice message for notifying a user of the location where the burglary occurs and the occurrence of the burglary.

Immediately after the terminal 31*c* ends data communication with the central processing device 10, the terminal 31*c* reads the setting information from the data storage unit 55 and performs the following operations depending on the read set values. More specifically, when the terminal 31*c* is set to generate preliminary warning (S55), the terminal 31*c* generates the preliminary warning for the set time (S56). In addition, after the set warning delay time elapses (S57), the warning is generated with the set alarm type, at the set sound volume, for the set warning time (S58).

When the terminal 31*c* receives a request for canceling the alarm operation from the central processing device 10 (S52), the terminal 31*c* returns from the autonomous alarm operation state to the setting standby process.

The terminal having the burglary sensor has been described above, however the autonomous alarm operation can also be similarly applied to a terminal of a type different from the above type.

As described above, the terminal can start or cancel the autonomous alarm operation by a command from the central processing device. Once the alarm operation is started, the terminal performs the autonomous alarm operation, and can perform the warning operation, including the preliminary warning operation, using the decision of the terminal. Furthermore the terminal can transmit information indicating the occurrence of the burglary to the central processing device. The central processing device can perform a predetermined process including sending a message to an external telephone. The series of operations can be realized by bidirectional communication in a downstream direction from the central processing device to the terminal and an upstream direction from the terminal to the central processing device.

The terminal is arranged to perform an autonomous alarm operation including a warning operation, as described above. Thus, in comparison with a conventional system in which only a central processing device has a warning means, it is possible to threaten by directly broadcasting a warning to a site where the burglary occurs. Accordingly, the burglar can be effectively prevented from intruding on a residence. In particular, when the site is distant from the central processing device such as being partitioned by a door or the like, the present invention is advantageous.

The warning unit 54 may be a warning generation means such as a loudspeaker or a bell in addition to a buzzer which produces sound at a large volume. Furthermore, optical warning means such as a flashlight or a revolving light may be used, the same effect as described above can be achieved.

As described above, according to the present invention, an autonomous alarm operation including a warning operation can be performed by a terminal itself, and a warning can be directly generated at a site where a nonstationary state occurs. In addition, once a command for starting an alarm operation is received, even though a radio communication situation deteriorates due to noise or the like, a warning can be autonomously generated at the site. Thus, a monitoring system having high reliability can be structured. Various set values related to a warning are stored in the terminal, so that the types of desired warnings can be concentrically set for the respective terminals in the central processing device by a user.

Sixth Embodiment

As shown in FIGS. 1, 2, and 5, the central processing device 10 can be connected to the data server 75 on the internet 110 through the network connection unit 13*b*. The following applications using the predetermined data server 75 (to be referred to as a "center server" hereinafter) on the internet 110 can be considered.

The central processing device 10 sequentially creates a warning history of warning operations performed on terminals to the data server 75. The center server records the warning history on a recording medium such as a hard disk in the center server, and sets the warning history to be available for browsing on the WEB (homepage) prepared for the monitoring system. Thus, a user can access the center server through the internet to browse the WEB, so that the user can check the warning history.

When the central processing device 10 sets or cancels the alarm operation, it accesses the center server through the internet and transmits information for setting/canceling the alarm operation to the center server. The center server records the information in a recording means such as a hard disk in the center server and sets the information capable of being browsed on the WEB. Thus, a user can access the center server through the internet to browse the WEB, so that the user can check an alarm setting state and an alarm canceling state of the central processing device.

Buttons for instruction for setting/canceling an alarm operation are displayed on the WEB on the data server 75 for the central processing device 10. When these buttons are depressed by a user, command data corresponding to the buttons are transmitted from the data server 75 to the central processing device 10 through the internet 110. When receiving the command data, the central processing device 10 sets/cancels the alarm operation. When an alarm setting for the central processing device 10 is executed through the WEB, if a door-lock check is abnormal, failure of the setting may be displayed on the WEB.

The central processing device 10 receives information for an open/close state of a window or a door from the terminal and transmits the information to the center server 75. The center server 75 records the information in a recording means such as an internal hard disk and sets the information capable of being browsed on the WEB. Thus, a user can access the center server through the internet to browse the WEB, so that the opening/closing state of the window or the door can be checked.

Regarding execution of an alarm setting through the WEB or WEB browsing on the central processing device 10, a personal identification number or a password for the execution of alarm setting or the WEB browsing may be stored in the data server 75. When a user executes the alarm setting or browses the WEB, the user is required to enter the personal identification number or the password. Only when the entered personal identification number or the password coincides with that which is registered in the center server 75, the user may be allowed to perform the execute of the alarm setting or the WEB browsing.

As described above, everywhere in an environment in which the internet can be used, the user can check the state of the monitoring system or can set/cancel the alarm operation.

The six embodiments of the monitoring system according to the present invention have been described above, however the features of the present invention described in the six embodiments can be properly combined to each other and applied. In the above embodiments, the operations performed when the alarm operation is set are mainly described. However, the procedures for communication establishment and command transmission in the operation of canceling the alarm operation can be considered as the same procedures as those performed when the alarm operation is set.

The monitoring system described in the above embodiments is a system for preventing crime or notifying urgently. The "nonstationary state" mentioned here means a state in which the burglary occurs or a state in which an emergency situation occurs. The monitoring system can also be used for other purposes such as disaster prevention and medical services. In this case, the same system configuration can be used. More specifically, in case of disaster prevention, the nonstationary state includes occurrence of a state such as a fire disaster, earthquake, gas leakage, or generation of a toxic gas. Detection means corresponding to these states may be arranged in the terminal. In a medical system, the nonstationary state includes sudden changes of physiological indexes such as a blood pressure, a pulse, a breathing rate, and a constituent of blood, detection means corresponding to the physiological indexes may be similarly arranged in the terminal. In these cases, it is very effective means to check the situation of the site where the nonstationary state occurs or call for to the site by an external communication means.

The number of terminals is not limited to that described in the examples above. It may be arbitrarily set as long as the address codes and state codes of the terminals can be specified.

In the burglary sensing means in the examples above is constituted by a lead switch sensitive to the motion of a magnet of a movable part. However, when a human body sensor such as a pyroelectric infrared sensor is used, the same effect can be achieved.

The emergency call means in the examples above is constituted by a push button switch. However, a means using another kinetic contact mechanism such as a mechanism in which a contact is closed by gripping may be used. In addition, when a means for transmitting a sudden change in state as occurrence of a nonstationary state in automatic conjunction with a sensor for measuring physiological indexes is used, the same effect as described above can be obtained.

A camera for imaging a situation around a terminal may be built in the terminal in the examples. When the terminal detects occurrence of burglary or an emergency situation, the situation at the site is imaged by the camera, the imaged video information may be stored in the data storage unit 15*b* of the central processing device 10, or the video information may be transmitted to the center server 75. The center server 75 records the information on a recording medium such as a hard disk arranged therein, and sets the information capable of being browsed on the WEB.

In the examples above, a wireless medium is used as a communication medium. However, any communication medium such as cable communication by a leased circuit, electric line carrier communication, infrared communication, or optical fiber communication can be used, the same effect as described above can be achieved.

The examples have been described by using telephones and a public circuit. However, the present invention is not limited to the examples. A communication device such as a personal computer or a mobile information terminal may be used, or a leased line or the internet may be used.

In the above examples, the telephones 71, 72 or 73 and the terminal are designed to communicate with each other by using a telephone line. However, using an internet telephone system through the internet, voice communication between a voice communication device as a predetermined notification destination and a terminal may be established. Thus, since it is enough to connect only the internet circuit to the central processing device, the unit can be rationalized, and a communication cost can be reduced to lower than that of voice communication established by a conventional telephone circuit. Therefore, the system has an economical advantage.

The present invention has been described with reference to the specific embodiments. However, it is apparent to a person skilled in the art that many modifications, changes, and other uses are effective. Therefore, the present invention is not limited to the specific disclosures mentioned here, and can be limited by the accompanying claims.

What is claimed is:

1. A monitoring system for monitoring predetermined monitoring points, the monitoring system comprising:

a plurality of terminals for monitoring whether each predetermined monitoring point is in a stationary state or a non-stationary state, the plurality of terminals including a remote operation terminal and a sensor terminal; and a central processing device for setting and canceling an alarm operation of each of the terminals, and including a storage unit and a display unit, wherein:

the central processing device includes a communication unit that (i) receives stationary/non-stationary information, which is information indicating the stationary state or the non-stationary state of each of the predetermined monitoring points, from each of the terminals and (ii) transmits predetermined information, which is information including commands, to each of the terminals;

each terminal of the plurality of terminals includes a communication unit that (i) transmits the stationary/non-stationary information to the communication unit of the central processing device and (ii) receives the predetermined information from the communication unit of central processing device;

the remote operation terminal includes (i) a remote operation unit that transmits set/cancel information, which is information for setting or for canceling the alarm operation of a terminal of the plurality of terminals, according to an operation of a user, and (ii) a notification unit for providing an acceptance notification, which is a notification that the transmission of the set/cancel information is accepted, via at least one of a visual notification and an auditory notification, in response to a confirmation signal transmitted from the central processing device;

the central processing device transmits a set/cancel command, which is a command for setting or canceling the alarm operation of a portion of the terminals, the set/cancel command is transmitted to each of the terminals except the remote operation terminal, when the transmission of the set/cancel information from the remote operation terminal is accepted;

the sensor terminal includes an open/closed sensor for detecting an open state and a closed state of an article, including a door or a window, and for transmitting open/closed state information, which is information indicating the open state or the closed state of the article;

the central processing device stores the open/closed state information, transmitted from the sensor terminal, in the storage unit;

when the set/cancel information for setting the alarm operation is received from the remote operation terminal and when the open/closed state information stored in the storage unit indicates the open state, then the central processing device displays that a door-lock check is abnormal on the display unit, and transmits a door-lock check abnormal signal to the remote operation terminal; and the notification unit of the remote operation terminal notifies the user via at least one of the visual notification and the auditory notification, that the door-lock check is abnormal when the door-lock check abnormal signal is received from the central processing device.

2. The monitoring system according to claim 1, wherein a terminal of the plurality of terminals includes a controller that receives an autonomous command from the central processing device, the autonomous command being a command to autonomously start the alarm operation, and includes an alarm unit that generates a warning if the non-stationary state occurs.

3. The monitoring system according to claim 2, wherein:

the central processing device includes an operation unit for setting or canceling the alarm operation; and the central processing device transmits a setting command, which is a command for setting the alarm operation, to a terminal of the plurality of terminals when a predetermined time elapses after the operation unit sets the alarm operation.

4. The monitoring system according to claim 2, wherein a terminal of the plurality of terminals includes a warning unit and a storage unit that stores delay time information, which is information for delaying a generation of a warning by the warning unit by for a predetermined period of time after the non-stationary state occurs.

5. The monitoring system according to claim 4, wherein the warning unit generates a normal warning after a preliminary warning is generated if the non-stationary state occurs.

6. The monitoring system according to claim 5, wherein the storage unit of the terminal including the storage unit is operable to store at least one of a notification time, a sound volume, and a sound type, related to at least one of the normal warning and the preliminary warning.

7. The monitoring system according to claim 6, wherein at least one of the notification time, the sound volume, and the sound type, related to at least one of the normal warning and the preliminary warning and stored in the storage unit is instructed by the central processing device.

8. The monitoring system according to claim 1, wherein:

a terminal of the plurality of terminals includes an emergency call unit that transmits non-stationary state information, which is information indicating a non-stationary state, according to an operation of the user, and includes a notification unit that provides a notification by at least one of a visual notification and an auditory notification;

when the non-stationary state information is received from the emergency call unit, the central processing device transmits the confirmation signal to the terminal including the emergency call unit; and when the confirmation signal is received from the central processing device, the terminal including the emergency call unit provides a notification, via the notification unit, that the transmission of the non-stationary state information is accepted.

9. The monitoring system according to claim 8, wherein a terminal of the plurality of terminals includes:

at least one of the open/closed sensor and a human body sensor for detecting the presence and absence of a human body;

a warning unit; and a controller that receives an autonomous command from the central processing device, the autonomous command being a command to autonomously start the alarm operation, and that generates a warning via the warning unit if the non-stationary state occurs.

10. The monitoring system according to claim 9, wherein, when non-stationary state information is received from the terminal including the emergency call unit, the central processing device transmits a warning command, which is a command to generate the warning, to another terminal of the plurality of terminals which includes a warning unit to cause the warning unit of the terminal which received the warning command to generate a warning.

11. The monitoring system according to claim 9, wherein:

the central processing device includes an operation unit for setting or canceling the alarm operation; and the central processing device transmits a setting command, which is a command for setting the alarm operation, to a terminal of the plurality of terminals when a predetermined time elapses after the operation unit sets the alarm operation.

12. The monitoring system according to claim 9, wherein a terminal of the plurality of terminals includes a storage unit that stores delay time information, which is information for delaying the generation of the warning via the warning unit for a predetermined period of time after the non-stationary state occurs.

13. The monitoring system according to claim 12, wherein the warning unit generates a normal warning after a preliminary warning is generated if the non-stationary state occurs.

14. The monitoring system according to claim 13, wherein the storage unit of the terminal including the storage unit is operable to store at least one of a notification time, a sound volume, and a sound type, related to at least one of the normal warning and the preliminary warning.

15. The monitoring system according to claim 14, wherein at least one of the notification time, the sound volume, and the sound type related to at least one of the normal warning and the preliminary warning and stored in the storage unit is instructed by the central processing device.

16. The monitoring system according to claim 1, wherein, when stationary or non-stationary state information is received from a terminal of the plurality of terminals, the central processing device transmits a notification reset signal to the terminal which transmitted the stationary or non-stationary state information, and each of the terminals which received the notification reset signal completes the transmission of the stationary or non-stationary state information.

17. The monitoring system according to claim 16, wherein, if the terminal which transmitted the stationary or non-stationary state information does not receive the notification reset signal from the central processing device, then the terminal which transmitted the stationary or non-stationary state information that did not receive the notification reset signal repeats the transmission of the stationary or non-stationary state information a predetermined number of times.

18. The monitoring system according to claim 1, wherein, when a set/cancel command, which is a command for setting or canceling the alarm operation, is received by a terminal of the plurality of terminals from the central processing device, the terminal of the plurality of terminals which received the set/cancel command shifts to an alarm setting state or an alarm canceling state and transmits a shift confirmation signal to the central processing device, and then the central processing device completes the transmission of the set/cancel command in response to the shift confirmation signal.

19. The monitoring system according to claim 18, wherein;

the central processing repeats, a predetermined number of times, transmission of the set/cancel command to the terminal of the plurality of terminals which received the set/cancel command and from which the shift confirmation signal cannot be received; and when a terminal from which the shift confirmation signal cannot be received exists after the transmission of the set/cancel command is repeated the predetermined number of times, the central processing device stores abnormal information, which is information identifying the terminal from which the shift confirmation signal cannot be received as an abnormal devices in the storage unit.

20. The monitoring system according to claim 1, wherein the storage unit of the central processing device stores information related to the stationary or non-stationary state including an operation history or an alarm history of a terminal of the plurality of terminals.

21. The monitoring system according to claim 1, wherein the display unit of the central processing device displays information related to the stationary or non-stationary state.

22. The monitoring system according to claim 21, wherein:

a terminal of the plurality of terminals includes a battery for providing a voltage to the terminal including the battery and includes a voltage detection unit that detects the voltage of the battery and transmits a voltage drop signal to the central processing device when the detected voltage of the battery is equal to or below a predetermined voltage; and the central processing device displays information on the display unit indicating that the battery of the terminal including the battery has run out, when the voltage drop signal is received from the terminal including the battery.

23. The monitoring system according to claim 1, wherein the central processing device includes a public network connection unit that connects to a communication device, which is registered in advance, via an outside line when the non-stationary state information is received to notify the communication device that the non-stationary state has occurred.

24. The monitoring system according to claim 23, wherein:

the central processing device includes a voice communication unit that transmits and receives an audio signal from among a microphone, a loudspeaker, and the communication device; and the central processing device is operable to communicate with the communication device when a predetermined confirmation signal is transmitted from the communication device to the central processing device in response to the notification of the non-stationary state to the communication device.

25. The monitoring system according to claim 24, wherein the central processing device is operable to set or cancel the alarm operation when a predetermined setting signal is received from the communication device.

26. The monitoring system according to claim 23, wherein:

a terminal of the plurality of terminals includes a voice communication unit that transmits and receives an audio signal from among a microphone, a loudspeaker, and the central processing device;

the central processing device includes a voice communication unit that transmits/receives an audio signal to/from the communication device; and the central processing device enables communication between the communication device and the terminal including the voice communication unit via the central processing device when a predetermined confirmation signal is transmitted from the communication device to the central processing device in response to the notification of the non-stationary state to the communication device.

27. The monitoring system according to claim 23, wherein, if non-stationary state information is received by the central processing device from a terminal of the plurality of terminals, the central processing device transmits the non-stationary state information to the communication device, and a predetermined confirmation signal is transmitted from the communication device to the central processing device, then the central processing device transmits a stop signal, which is a signal instructing a stop of a warning, to a terminal of the plurality of terminals which generates the warning.

28. The monitoring system according to claim 27, wherein, when a predetermined signal for generating or stopping the warning is received by the central processing device, the central processing device transmits a generate/stop command, which is a command for generating or stopping the warning, to the terminal which generates the warning.

29. The monitoring system according to claim 23, wherein, when a predetermined confirmation signal is not returned from the notified communication device within a predetermined period, the central processing device selects, in a sequential and circular manner, another communication device of a plurality of communication devices registered in advance and notifies the another communication device if a non-stationary state occurs.

30. The monitoring system according to claim 29, wherein, when the predetermined confirmation signal is not returned to the central processing device after the central processing device has circulated through each communication device of the plurality of communication devices a predetermined number of times, the central processing device stores confirmation information, which is information indicating that communication cannot be confirmed, in the storage unit as a history and displays the confirmation information on the display unit.

31. The monitoring system according to claim 1, wherein the central processing device includes an internet connection unit that connects to a center server via the internet using bidirectional communication.

32. The monitoring system according to claim 31, wherein the central processing device transmits, to the center servers predetermined history information including a warning history.

33. The monitoring system according to claim 31, wherein internet pages, from which an alarm setting state and an alarm canceling state of the central processing device can be confirmed, are structured in the center server.

34. The monitoring system according to claim 31, wherein internet pages, from which setting and canceling of the alarm operation of the central processing device can be performed, are structured in the center server.

35. The monitoring system according to claim 34, wherein, if the door-lock check is abnormal during the setting of the alarm operation of the central processing device via the internet pages, the center server displays a failure of a setting on the internet pages.

36. The monitoring system according to claim 1, wherein the central processing device includes an external output terminal to which an external device can be connected.

37. The monitoring system according to claim 1, wherein the storage unit of the central processing device stores a predetermined personal identification number required when the alarm operation is set or canceled.

* * * * *